United States Patent [19]

Shiba et al.

[11] Patent Number: 5,051,342

[45] Date of Patent: Sep. 24, 1991

[54] SILVER HALIDE PHOTOGRAPHIC MATERIALS AND METHOD FOR COLOR DEVELOPMENT THEREOF

[75] Inventors: Keisuke Shiba; Kazunori Hasebe; Seiji Ichijima, all of Kanagawa, Japan

[73] Assignee: Fuji Photo Film Co., Ltd., Kanagawa, Japan

[21] Appl. No.: 548,433

[22] Filed: Jul. 5, 1990

Related U.S. Application Data

[62] Division of Ser. No. 326,861, Mar. 22, 1989, abandoned.

[30] Foreign Application Priority Data

Mar. 22, 1988 [JP] Japan ..... 63-67738

[51] Int. Cl.[5] ..... G03C 7/30

[52] U.S. Cl. ..... 430/383; 430/376; 430/434; 430/467; 430/507; 430/510; 430/607; 430/611; 430/613; 430/963

[58] Field of Search ..... 430/372, 376, 382, 383, 430/434, 464, 467, 505, 507, 510, 567, 607, 611, 613, 963

[56] References Cited

U.S. PATENT DOCUMENTS

| | | | |
|---|---|---|---|
| 4,798,783 | 1/1989 | Ishikawa et al. | 430/434 |
| 4,800,153 | 1/1989 | Morimoto et al. | 430/434 |
| 4,830,948 | 5/1989 | Ishikawa et al. | 430/434 |
| 4,833,068 | 5/1989 | Ohki et al. | 430/434 |
| 4,900,651 | 2/1990 | Ishikawa et al. | 430/434 |

*Primary Examiner*—Hoa Van Le

*Attorney, Agent, or Firm*—Sughrue, Mion, Zinn Macpeak & Seas

[57] ABSTRACT

A silver halide photographic light-sensitive material having at least one light-sensitive emulsion layer containing surface latent image-type silver halide grains, coated on a reflective support, in which said at least one emulsion layer contains regular crystal grains of silver chloride or silver chlorobromide having a mean silver chloride content of 80 mol % or more on the basis of the total silver halide grains contained therein and substantially does not contain silver iodide, and in which a colloidal silver-containing layer is located adjacent to said emulsion layer, wherein at least one of said colloidal silver-containing layer, said emulsion layer and an interlayer therebetween contains at least one mercaptoazole compound. The material is, after having imagewise exposed, processed with a color developer within 90 seconds. The material forms an image with excellent sharpness and whiteness.

16 Claims, No Drawings

SILVER HALIDE PHOTOGRAPHIC MATERIALS AND METHOD FOR COLOR DEVELOPMENT THEREOF

This is a divisional of application Ser. No. 07/326,861 filed Mar. 22, 1989, now abandoned.

FIELD OF THE INVENTION

The present invention relates to a silver halide photographic light-sensitive material and to a method for rapid processing of the material.

BACKGROUND OF THE INVENTION

Various kinds of silver halide photographic materials have now been commercially sold and various means of processing the materials for image formation thereon are known. In addition thereto, other various technical means are being popularized, including high-vision TV-systems, color-printing systems and color electrophotographic systems. Under the current situation, silver halide color photographic materials, especially color-printing photographic materials, are increasingly required to have an excellent image quality and a high stability of the finished print quality.

In general, printing photographic materials are superior to picture-taking photographic materials in terms of the color reproducibility, sharpness and gradation of the images formed, although the former take a longer time for development than the latter, and further improvement of the photographic characteristics of the photographic materials are being effected. Printing photographic materials which are used in combination with picture-taking photographic materials are good in terms of the producibility in production of prints, for example, these may be processed in a shortened period of time or may be automatically processed, but the image quality of the images formed in the materials (for example, color reproducibility, sharpness, gradation and whiteness) is still insufficient and is therefore required to be improved further. In particular, various practical improvements have been effected in color negative photographic materials. For example, colored couplers, DIR-compounds or DAR-compounds (development accelerator releasing compound) are incorporated; sensitizing dyes are selectively incorporated so as to select the spectral sensitivity distribution and to control the degree of the interlayer effect; dyes are incorporated for the purpose of anti-irradiation or anti-halation; or the thickness of the light-sensitive layer is decreased. Color-printing photographic materials which are used for forming prints from exposed and developed color negative films have also been improved. For example, couplers to be incorporated therein are improved; anti-fading agents or color mixing preventing agents are incorporated; and dyes to be incorporated for the purpose of selecting the spectral sensitivity distribution and for the purpose of anti-irradiation or anti-halation are improved. However, silver halide color photographic materials having a reflective support often have a serious defect in that the image quality is deteriorated by light-scattering of the incident light for exposure.

The main factors causing deterioration of the image quality are considered to be the following three matters.

(1) Elevation of the degree of the whiteness of the reflective (first grade diffusive and reflective: the definition for this term can be seen in "Hand Book of Science of Color (new edition)", edited by Japan Color Society; published by Tokyo University Publication Association; Sept. 10, 1985; Chapter 18, page 626) support causes increase of halation.

(2) Incorporation of high silver chloride emulsions causes not only intensification of the reflective light but also a decrease of the interlayer effect or interimage effect in development to thereby cause deterioration of the sharpness.

(3) Increase of the amount of the dye to be used causes not only an increase of the light absorption in exposure to thereby cause desensitization but also an increase of undesirable color remaining in the processed materials.

If attempts are made to eliminate or overcome the drawbacks by increasing the amount of a conventional water-soluble dye to be added to the photographic materials, such brings about relatively great lowering of the sensitivity and softening of the gradation.

On the other hand, when the time for development is shortened, dyes often remain in the film to lower the degree of the whiteness.

It is known to form an anti-halation layer so as to prevent deterioration of the image quality caused by light-scattering of the incident light. (For example, such is disclosed in U.S. Pat. Nos. 2,882,156, 2,326,057, 3,740,228, 2,839,401 and 3,625,691, JP-B-49-15820 and JP-A-55-33172 and JP-A-59-193447. The terms "JP-A" and "JP-B" as used herein mean "unexamined published Japanese patent application" and "examined Japanese patent publication", respectively.) Picture-taking color photographic materials have been proposed that have a colloidal silver containing anti-halation layer.

However, no color photographic paper is known, which has an anti-halation layer on a reflective support and which has a silver chloride-rich silver chlorobromide emulsion layer (where the mean silver chloride content of the total silver halide is 80 mol % or more) coated thereon and which can be processed by rapid color development within a period of 90 seconds or less.

In this connection, it is known from the example of JP-A-62-32448 that a color-printing photographic material which has a colorant-containing layer (black colloidal silver-containing layer), a red-sensitive emulsion layer comprising tabular silver chlorobromide grains (AgBr content: 85 mol %) having a mean aspect ratio of 5 or more, a silver chlorobromide blue-sensitive layer (AgBr content: 80 mol %) and a silver chlorobromide green-sensitive layer (AgBr content: 70 mol %) formed on a white reflective support has an effectively improved sharpness. However, a printing photographic material containing both colloidal silver and a high silver chloride emulsion as well as a method of processing the material by a rapid color development system is unknown.

The present inventors have found that provision of a colloidal silver-containing anti-halation layer or filter layer in a high silver chloride printing photographic material yields the following problems (1) and (2).

(1) Colloidal silver causes formation of stain. (the stain comprises yellow coloring in the non-exposed area caused by solution physical development in the presence of the colloidal silver.)

(2) Contrast of the gradation in the highlight area (or the gradation of the toe in the characteristic curve) is softened.

SUMMARY OF THE INVENTION

Accordingly, the first object of the present invention is to overcome the problems in the prior art and to provide a high silver chloride printing photographic light-sensitive material capable of forming an image with excellent sharpness and whiteness.

The second object of the present invention is to provide a method of processing the printing photographic material by a rapid color development system.

The objects of the present invention can be attained by providing a silver halide photographic light-sensitive material having at least one light-sensitive emulsion layer containing surface latent image-type silver halide grains, coated on a reflective support, in which the at least one emulsion layer contains regular crystal grains of silver chloride or silver chlorobromide having a mean silver chloride content of 80 mol % or more on the basis of the total silver halide grains contained therein and substantially does not contain silver iodide, and the photographic material has a colloidal silver-containing layer adjacent to the emulsion layer, wherein at least one of the colloidal silver-containing layer, the emulsion layer, and an interlayer therebetween contains at least one mercaptoazole compound.

According to one preferred embodiment of the material of the invention, the surface latent image-type silver halide grain-containing light-sensitive emulsion layer contains regular crystal grains of silver chloride or silver chlorobromide having a mean silver chloride content of 80 mol % or more on the basis of the total silver halide grains contained therein and substantially does not contain silver iodide, and in which at least 50% by weight, preferably 70% by weight or more, of the silver halide grains (based on the total silver halide grains) contained in the emulsion layer have at least one silver bromide locallized phase inside of and/or on the surface of each of the grains.

According to another preferred embodiment of the invention, the silver halide photographic material is, after being imagewise exposed, color-developed with a substantially silver bromide-free color developer within 90 seconds.

DETAILED DESCRIPTION OF THE INVENTION

In the present invention, "adjacent to the emulsion layer" means that to directly contact to the emulsion layer or to contact to the emulsion layer via an interlayer which is a light-insensitive hydrophilic colloid layer.

The content of the colloidal silver in the colloidal silver-containing layer for use in the present invention is preferably from 0.01 to 0.5 g/m$^2$ as silver. As the colloidal silver, a yellow or black colloidal silver, which is used in a conventional filter layer or antihalation layer can be used. The method for preparing the colloidal silver-containing layer will be concretely described in the examples to follow hereunder. The colloidal silver is removed in the photographic processing step, i.e., in any of the bleaching step and fixation step or bleach-fixation step.

The surface latent image-type silver halide grains for use in the present invention are grains which form a latent image mainly on the surface of the grain, which are therefore differentiated from internal latent image-type silver halide grains which form a latent image mainly in the inside of the grain.

One means of differentiating an internal latent image-type emulsion from others is as follows. The silver halide emulsion to be determined is coated on a transparent support in a determined amount, this is exposed for a determined period of from 0.01 second to 10 seconds and then developed with the following developer (A) (internal developer) at 18° C. for 5 seconds, and the maximum density of the image formed is determined by conventional photographic densitometry. On the other hand, the same silver halide emulsion is coated on the same support in the same manner as above and then exposed also in the same manner as above. The thus exposed material is then developed with the following developer (B) (surface developer) at 20° C. for 6 minutes and the maximum density of the image formed is determined also in the same manner as above. When the value of the maximum density obtained in the former manner (developed with the internal developer (A)) is at least 5 times or more that obtained in the latter manner (developed with the surface developer (B)), the emulsion tested is an internal latent image-type emulsion. Internal Developer (A):

| | |
|---|---|
| Internal Developer (A): | |
| Metol | 2 g |
| Sodium sulfite (anhydride) | 90 g |
| Hydroquinone | 8 g |
| Sodium carbonate (monohydrate) | 52.5 g |
| KBr | 5 g |
| KI | 0.5 g |
| Water to make | 1 liter |
| Surface Developer (B): | |
| Metol | 2.5 g |
| L-ascorbic acid | 10 g |
| $NaBO_2.4H_2O$ | 35 g |
| KBr | 1 g |
| Water to make | 1 liter |

The surface latent image-type silver halide for use in the present invention is preferably silver chloride or silver chlorobromide grains having a mean silver chloride content of 90 mol % or more on the basis of the total silver halide grains contained in the emulsion layer. In the present invention "substantially does not contain silver iodide" means that the mean silver iodide content in the silver halide is 1 mol % or less, most preferably 0 (zero) mol % from the view point of a rapid process.

In accordance with the present invention, the high silver chloride emulsion may be incorporated into the emulsion layer either singly or in the form of a mixture of two or more high silver chloride emulsions.

The silver halide in the high silver chloride emulsion layer for use in the present invention preferably comprises regular crystal grains in a proportion of 80% by weight or more, most preferably 100% by weight, of the total silver halide in the layer. The regular crystal grains are, for example, those having a regular crystal form such as cubic, rectangular parallelpiped, 12-hedral, 14-hedral or 8-hedral crystal form.

More preferably, the regular crystal grains have a silver bromide-locallized phase, which has a higher silver bromide content than the adjacent phase, in the inside and/or surface of the grain. The locallized phase may exist in the grain in the form of a layer, an insulated island or as an discontinuous layer. Especially preferably, the locallized phase exists in the form of an insulated island in the surface of the grain or as a thin film on the surface of the grain. Regular crystal grains have a weaker light-scattering reflectivity than other irregular grains and therefore can easily obtain a sharp gradation in the highlight area (toe-cut characteristic curve), so that these are advantageous for improving the sharpness (observed by naked eyes) of the emulsion. In particular, silver bromide-localized phase-having grains can more easily obtain an interimage effect than the other grains and therefore are advantageous for improving the defect of high silver chloride grains.

The silver bromide-localized phase preferably comprises silver bromide or silver chlorobromide having a silver bromide content of from 5 to 100 mol %, more preferably from 15 to 70 mol %, most preferably from 20 to 60 mol %. The silver salt other than the silver bromide-localized phase may be any other silver salt than silver halides, for example, silver rhodanide. The localized phase preferably accounts for from 0.1 to 20 mol % as silver, especially preferably from 0.5 to 7 mol % as silver, of the total silver amount of the silver halide grains in the emulsion.

The silver bromide content in the localized phase can be analyzed by an X-ray diffraction method (for example, as described in *New Experimental Chemistry, Lecture VI, Analysis of Structure* (edited by Japan Chemical Society and published from Maruzen, Japan) or an XPS method (for example, as described in *Surface Analysis—Application of IMA, Auger Electron and Photoelectronic Spectrography* (published by Kodansha, Japan).

The interface between the localized phase and the other phase may be definite, or it may have a short transition region where the phase gradually varies.

The localized phase and/or the other phase (substrate) preferably contains at least one metal ion of Group VIII of the Periodic Table,, such as, an Ir, Rh, Pt, Fe or Pd ion. These phases may contain different metal ions, and further, these phases may contain the same metal ion in different amounts.

For formation of the localized phase, various means of forming conventional silver halides can be employed (methods as disclosed in, for example, Ep 273430). For instance, a soluble silver salt and a soluble halide may be reacted by the single-jet method or double-jet method to form the intended localized phase. Further, the localized phase may also be formed by a so-called conversion method containing a step of converting the already formed silver halide to another silver halide having a smaller solubility product. Alternatively, the localized phase may be formed by adding fine silver bromide grains to recrystallize the intended silver bromide phase on the surface of the already formed silver chloride grains.

It is preferred that the localized phase is precipitated together with at least 50% of the total iridium to be added in preparation of the silver halide grains.

In order to precipitate the localized phase together with the iridium ion, an iridium compound may be added to the reaction system, simultaneously with the addition of silver and/or halogen thereto or immediately before or immediately after the addition thereof.

The Group-VIII metal ions may be incorporated into the silver halide grains in accordance with the method of incorporating the iridium ion thereinto as mentioned above.

The grain size of the silver halide grains for use in the present invention is preferably from 0.1 to 1.5 μm as the mean grain size. The grains preferably form a monodispersed emulsion.

The preferred monodispersed high-silver chloride emulsion for use in the present invention has a ratio of the statistical standard deviation (s) to the mean grain size ($\bar{d}$) ($s/\bar{d}$) of being 0.2 or less, especially 0.15 or less. The grain size is determined as the diameter of the circle corresponding to the projected area of the grain. When plural kinds of monodispersed emulsions are incorporated in one emulsion layer, at least one of them preferably has the value of the above-defined ratio ($s/\bar{d}$).

The silver halide grains for use in the present invention are required to be substantially surface latent image-type grains which have been chemically sensitized in some degree on the surface thereof. For such chemical sensitization, a sulfur sensitization method of using a sulfur-containing compound capable of reacting with an active gelatin or silver (for example, thiosulfates, thioureas, mercapto compounds, rhodanines), a reduction sensitization method of using a reducing substance (for example stannous salts, amines, hydrazine derivatives, formamidinesulfinic acids, silane compounds) and a noble metal sensitization method of using a metal compound (for example, gold complexes, as well as complexes of metals of Group VIII of the Periodic Table such as Pt, Ir, Pd, Rh or Fe) can be employed. The methods may be employed singly or in combination. Among the chemical sensitization methods, the sulfur sensitization method is preferably employed.

The photographic materials containing the thus prepared silver halide grains in accordance with the present invention have been found excellent, as they can advantageously be processed by a rapid processing procedure, they have high sensitivity and high contrast, they are almost free from reciprocity law failure, they have a high latent image stability and they may be handled with ease. Such advantages of the photographic materials provide a striking contrast to the common sense in the field of the conventional silver chloride emulsions. In addition, the particular high-silver chloride grains are effective for relatively reducing the drawback to be caused by the provision of the colloidal silver-containing layer in the photographic material of the present invention.

The photographic emulsion for use in the present invention can contain various compounds for the purpose of preventing fog during the preparation, storage or photographic processing step of the photographic material or for the purpose of stabilizing the photographic property of the material. Specifically, various compounds known as an anti-foggant or stabilizer can be used for the purpose, which, for example, include mercaptoazoles such as mercaptothiazoles, mercaptobenzothiazoles, mercaptobenzimidazoles, mercaptothiadiazoles, mercaptoxadiazoles, mercaptotetrazoles (especially, 1-phenyl-5-mercaptotetrazole and derivatives thereof where the phenyl group is substituted by an N-methyl-ureido group on the m-position thereof), mercaptopyrimidines, mercaptotriazines, mercaptotriazoles and mercaptoimidazoles; other azoles such as benzothiazolium salts, nitroimidazoles, nitrobenzimidazoles, chlorobenzimidazoles, bromobenzimidazoles, aminotriazoles, benzotriazoles and nitrobenzotriazoles; thioketo compounds such as oxadolinethione; azaindenes such as triazaindenes, tetrazaindenes (especially 4-hydroxysubstituted (1,3,3a,7-)tetrazaindenes) and pentazaindenes: as well as benzenesulfonic acid, benzenesulfinic acid and benzenesulfonic acid amide.

In accordance with the present invention, increase of stain caused by the colloidal silver-containing layer may effectively be inhibited by addition of at least one of the above-mentioned mercaptoazole compounds. These compounds can be obtained according on methods disclosed in, for example, U.S. Pat. Nos. 4,448,878 and 4,458,010.

Examples of preferred mercaptoazole compounds include compounds represented by the following general formulae (I), (II) or (III). They are included in at least one of the colloidal silver layer, the adjacent light-sensitive layer, and an interlayer (a hydrophilic layer, e.g., a gelatin layer) therebetween. The amount of the mercaptoazole compound to be added to the layer is preferably from $1\times10^{-5}$ to $1\times10^{-3}$ mol or so per mol of total amount of silver in the colloidal silver-containing layer and in the adjacent light-sensitive layer (silver halide is calculated as silver). The compound may not be adsorbed to the silver halide grains or colloidal silver. It is also effective to add a precursor of a mercaptoazole group or development inhibitor(a mercaptoazole compound)-releasing compound (DIR-compound) which may adsorb to the silver grains (colloidal silver and/or developed silver grains) only when the photographic material is processed in a color developer.

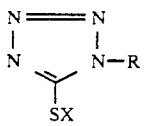
(I)

In the formula, R represents an alkyl group, an alkenyl group or an aryl group. X represents a hydrogen atom, an alkali metal atom, an ammonium group or a precursor thereof. The alkali metal atom includes, for example, a sodium atom and a potassium atom, and the ammonium group includes an unsubstituted (inorganic) and substituted (organic) ammmonium groups, for example, a tetramethylammonium group and a trimethylbenzylammonium group. The precursor means a group capable of being converted into a hydrogen atom or an alkali metal atom under an alkaline condition, which includes, for example, an acetyl group, a cyanoethyl group or a methanesulfonylethyl group.

In the above-mentioned R, the alkyl group and alkenyl group include unsubstituted groups and substituted groups and further include alicyclic groups. As substituents for the substituted alkyl group, there may be mentioned a halogen atom, a nitro group, a cyano group, a hydroxyl group, an alkoxy group, an aryl group, an aliphatic or aromatic acylamino group, an alkoxycarbonylamino group, an ureido group, an aliphatic or aromatic amido group, a heterocyclic group (preferably a 5- to 7-membered cyclic group containing at least one of N, O and S atoms as hetero atom), an aliphatic or aromatic acyl group, a sulfamoyl group, an aliphatic or aromatic sulfonamido group, a thioureido group, a carbamoyl group, an alkylthio group, an arylthio group, an amino group, a heterocyclic-thio group (preferably a 5- to 7-membered cyclic-thio group containing at least one of N, O and S atoms as hetero atom), as well as a carboxylic acid group, a sulfonic acid group and salts thereof.

The ureido group, thioureido group, sulfamoyl group, carbamoyl group, amino group, amido group and sulfonamido group includes unsubstituted groups, N-alkyl-substituted groups N-aryl-substituted groups and N-alkenyl-substituted groups. As examples of the aryl group, there are a phenyl group and a substituted phenyl group. As the substituents for the group, there are an alkyl group and the substituents mentioned above for the alkyl group of R.

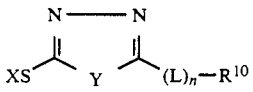
(II)

In the formula, Y represents an oxygen atom or a sulfur atom. L represents a divalent linking group; and $R^{10}$ represents a hydrogen atom, an alkyl group, an alkenyl group or an aryl group. The alkyl group, alkenyl group, and aryl group for R and X have the same meanings as those defined in the formula (I).

As examples of the divalent linking group for L, there are mentioned

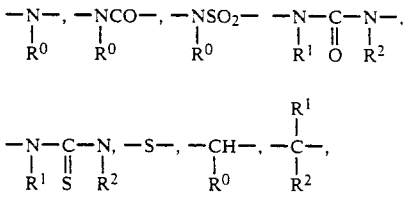

and combinations of these n represents 0 or 1; and $R^0$, $R^1$ and $R^2$ each represents a hydrogen atom, an alkyl group or an aralkyl group.

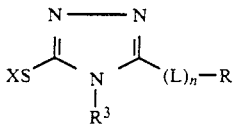
(III)

In the formula, R and X have the same meanings as defined in the formula (I); L and n have the same meaning as defined in the formula (II). $R^3$ has the same meaning as R and may be same as or different from R.

Specific examples of the compounds of the formulae (I), (II) and (III) are set forth below, which, however, are not limitative.

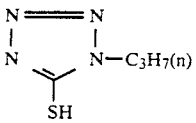
(1)

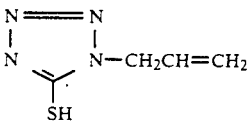
(2)

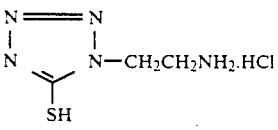
(3)

-continued (4)

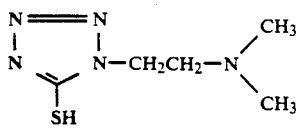

(5)

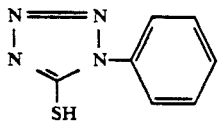

(6)

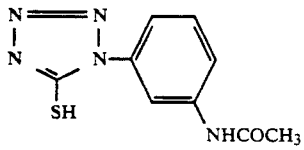

(7)

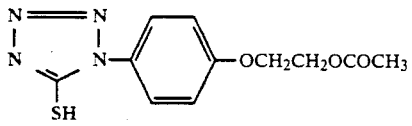

(8)

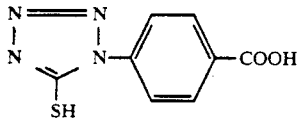

(9)

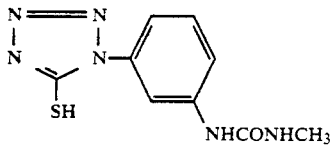

(10)

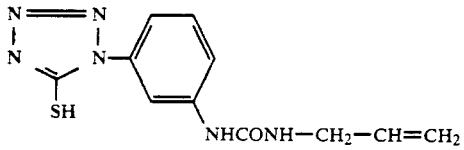

(11)

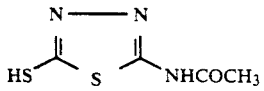

(12)

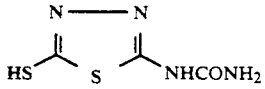

(13)

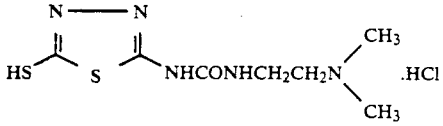

(14)

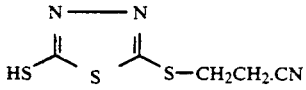

(15)

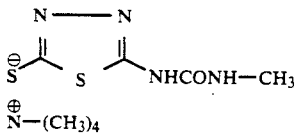

-continued (16)

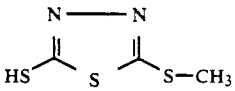

(17)

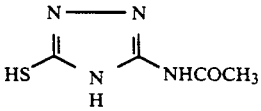

(18)

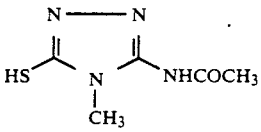

(19)

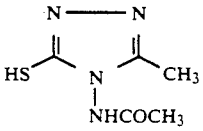

(20)

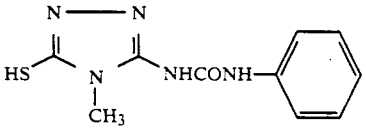

(21)

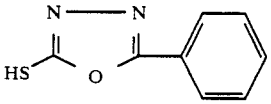

In the present invention two or more mercaptoazole compound may be used in combination.

The mercaptoazole compounds as represented by the aforesaid formula (I), (II) or (III) or precursors thereof or DIR-compounds (which releases a mercaptoazole compound) are effective in that they function to inhibit solution physical development by the colloidal silver, which is derived from the colloidal silver-containing layer provided in the photographic material of the invention, in the step of color development of the material and also function to inhibit physical development of the high silver chloride grains existing in the adjacent light-sensitive layer. In particular, formation of the stain can be synergestically inhibited by provision of a silver bromide locallized phase in the inside of and/or on the surface of the substrate of the high silver chloride grain.

In accordance with the present invention, at least one compound represented by the following formula (IV) or (V) is preferably additionally incorporated into at least one of the colloidal silver-containing layer, the adjacent light-sensitive layer, and the interlayer therebetween in a relatively small amount, preferably in an amount of from 0.01 to 0.2 g/m$^2$, whereby formation of the stain may more effectively be inhibited. They may be incorporated to the layer containing the mercaptoazole compound or may be incorporated to the other layers.

$$Cp—X^1 \quad (IV)$$

$$A_1—P—Ar—Q—A_2 \quad (V)$$

In the formula (IV), Cp represents a colorless coupler residue capable of forming a substantially colorless compound by coupling with the oxidation product of a color developing agent, or represents a coupler residue capable of forming a compound, which may be dissolved or diffused out of the layer of the photographic material, by coupling in the step of color development; and $X^1$ represents a coupling-releasing group.

In the formula (V), $A_1$ and $A_2$ each represents a hydrogen atom or a group capable of being cleaved by the action of an alkali; P and Q each represents an oxygen atom or a sulfonylimino group; and Ar represents an aromatic group, and $A_1$—P— and —Q—$A_2$ are bonded to the 1,2-positions or 1,4-positions of the aromatic group.

Compounds of the formula (IV) will be explained in detail hereunder.

Compounds to be directly formed by a coupling reaction of the coupler of the formula (IV) and the oxidation product of a developing agent are grouped into two types, color compounds and substantially colorless compounds. In the former case, the dyes derived from the compounds of the formula (IV) are not utilized in the image formation in the photographic materials of the present invention. That is, as preferred embodiments, the dyes formed in the step of development are soluble in an alkali and are diffused out from the photographic layer or are dissolved out therefrom into the developer, or they are reacted with the component in the developer, for example, sulfite ion or hydroxyl ion to be converted into substantially colorless compounds. Such reactions may be effected at the same time. In any way, the color compound formed in development by coupling of the coupler of the formula (IV) and the oxidation product of a developing agent remains in the photographic layer preferably only in an amount of 10% or less, more preferably only in an amount of 5% or less.

In the former case where the dyes formed are alkali-soluble, the dyes have a hydrophilic group, preferably a dissociatable group. The degree of the alkali-solubility of the dyes greatly fluctuates, depending upon the environmental condition in development, for example, the pH value of the processing solution used, the processing time and the structure of the developing agent used. However, the degree may be adjusted to a desired one by pertinent selection of the substituent contained in the group Cp in the compound of the formula (IV).

For the latter case where the dyes formed are reacted with the component in the developer to be converted into substantially colorless compounds, the reaction described, for example, in *Journal of The Japanese Photographic Society,* Vol. 27, page 172 (1964) and *Journal of the American Chemical Society,* Vol. 84, page 2050 (1962) may be referred to. The reaction speed of forming colorless compounds from the dyes depends upon the kinds of components contained in the developer used as well as the amounts thereof, but it may be adjusted to a desired degree by properly selecting the structure of the group of the aforesaid Cp as well as the substituents in the group.

For the group represented by Cp, conventional coupler residues may be applied. For example, there may be mentioned yellow coupler residues (e.g., open-chain ketomethylene coupler residues), magenta coupler residues (e.g., 5-pyrazolone or pyrazolotriazole coupler residues), cyan coupler residues (e.g., phenol or naphthol coupler residues) and colorless coupler residues (e.g., indanone or acetophenone coupler residues). In addition, heterocyclic coupler residues, such as those described in U.S. Pat. Nos. 4,315,070, 4,183,752, 3,961,959 and 4,171,223 may also be mentioned.

The compounds of the formula (IV) are preferably those having a non-diffusive group. The non-diffusive group acts to prevent the compound of the formula (IV) from moving and diffusing from the layer of the compound into any other layers. In general, an organic substituent to increase the molecular weight of the compound is used as the non-diffusive group.

When the group represented by Cp in the formula (IV) is an yellow coupler residue, a magenta coupler residue or a cyan coupler residue, the non-diffusive group is in the group represented by $X^1$, as one preferred embodiment. In such a case, $X^1$ may be a group capable of forming a bis-type, telomer-type or polymer-type coupler containing one or more Cp groups.

When the group represented by Cp in the formula (IV) is a colorless coupler residue, the non-diffusive group may be in any of the groups Cp and $X^1$. In such a case, Cp may contain two or more colorless coupler residues, or $X^1$ may be a group capable of forming a bis-type, telomer-type or polymer-type coupler containing one or more Cp groups.

In the formula (IV), $X^1$ represents a coupling-releasing group, and the group $X^1$ released by coupling includes two types: a group capable of reacting with the oxidation product of a developing agent and a group incapable of reacting with the same. In the former case where $X^1$ is a group capable of reacting with the oxidation product of a developing agent, $X^1$ is a group that becomes a coupler after being released from the group Cp, or it is a group that becomes a redox group after being released from the group Cp.

When $X^1$ is a group that becomes a coupler, for example a phenol coupler, after being released from the group Cp, the group $X^1$ is bonded to the group Cp via the oxygen atom of the hydroxyl group of the phenol coupler, after removal of the hydrogen atom from the hydroxyl group of the coupler. When $X^1$ is a group that becomes a 5-pyrazolone coupler, the group $X^1$ is bonded to the group Cp via the oxygen atom of the hydroxyl group of the tautomeric 5-hydroxypyrazole compound, after removal of the hydrogen atom from the hydroxyl group of the compound. In such examples, the group $X^1$ may form a phenol coupler or a 5-pyrazolone coupler only after being released from the group Cp. As a preferred example in such cases, the compounds have a non-diffusive group-containing coupling-releasing group at the coupling position.

When the group $X^1$ represents a group which takes part in a redox reaction in the formula (IV), $X^1$ is preferably a group of hydroquinones, catechols, pyrogallols, 1,4-hydroxynaphthols, sulfonamidophenols or 1,2-hydroxynaphthols.

The reducing agents preferably have a nondiffusive group.

The preferred range of the compounds of the formula (IV) will be mentioned in detail hereunder. One preferred embodiment of the compounds of the formula (IV) is represented by the following formula (VI).

$$\begin{array}{l} \mathrm{Cpp}-(\mathrm{Sol})_b \\ \quad\;\; | \\ \quad\;\; X^2 \end{array} \qquad \text{(VI)}$$

In the formula, Sol represents an alkali-soluble group; b represents an integer of from 1 to 3; Cpp represents a group capable of releasing the group $X^2$ in a coupling reaction with the oxidation product of a developing agent; and $X^2$ represents a non-diffusive group-containing coupling-releasing group.

Precisely, Sol represents a dissociatable group or a quaternary ammonium group, preferably a carboxylic acid group or a salt thereof, a sulfonic acid group or a salt thereof, a sulfinic acid group or a salt thereof, or a hydroxyl group. The salt includes, for example, sodium salt, potassium salt or ammonium salt.

Sol is especially preferably a carboxylic acid group or a sulfonic acid group or a salt thereof.

Of the compounds of the formula (VI), preferred are compounds represented by the following formulae (Cp-1), (Cp-2), (Cp-3), (Cp-4), (Cp-5), (Cp-6), (Cp-7) and (Cp-8).

(Cp-1)

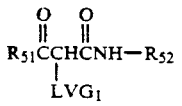

(Cp-2)

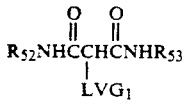

(Cp-3)

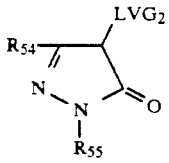

(Cp-4)

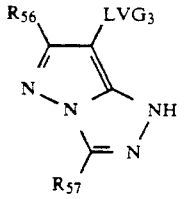

(Cp-5)

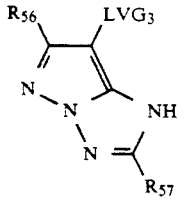

(Cp-6)

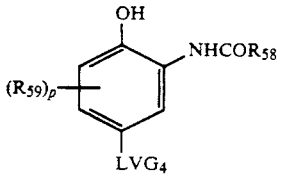

(Cp-7)

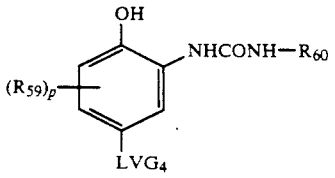

-continued (Cp-8)

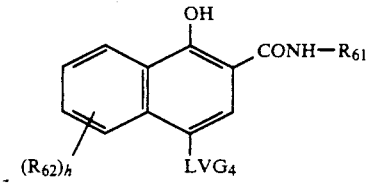

$R_{51}$ to $R_{62}$, $LVG_1$ to $LVG_4$, p and h will be explained hereunder.

In the above-mentioned formulae, $R_{51}$, $R_{52}$, $R_{53}$, $R_{54}$, $R_{55}$, $R_{56}$, $R_{57}$, $R_{58}$, $R_{59}$, $R_{60}$, $R_{61}$ and $R_{62}$ are independently preferred to have a total carbon number of 15 or less. $R_{51}$, $R_{52}$, $R_{53}$, $R_{55}$, $R_{58}$, $R_{60}$ and $R_{61}$ may optionally contain Sol as a substituent.

$R_{54}$, $R_{56}$, $R_{57}$, $R_{59}$ and $R_{62}$ may optionally contain Sol as a substituent, or they may be Sol.

In the following explanation, $R_{41}$ means an aliphatic group, an aromatic group or a heterocyclic group; $R_{43}$, $R_{44}$ and $R_{45}$ each mean a hydrogen atom, an aliphatic group or a heterocyclic group.

$R_{51}$ has the same meaning as $R_{41}$. $R_{52}$ and $R_{53}$ each represents an aromatic group or a heterocyclic group. $R_{54}$ has the same meaning as $R_{41}$ and additionally represents $$R_{41}\underset{\underset{R_{43}}{|}}{CON}-,\ R_{41}\underset{\underset{R_{43}}{|}}{N}-,\ R_{41}SO_2\underset{\underset{R_{43}}{|}}{N}-,\ R_{41}S-,\ R_{43}O-,$$

$$R_{45}\underset{\underset{R_{43}}{|}}{NCO}-\underset{\underset{R_{44}}{|}}{N}-,\ R_{43}OOC-,\ R_{44}\underset{\underset{R_{43}}{|}}{NCO}-\ \text{or}\ N\equiv C-.$$

$R_{55}$ has the same meaning as $R_{41}$. $R_{56}$ and $R_{57}$ have the same meaning as $R_{43}$ and additionally represent $R_{41}S$—, $R_{43}O$—, a carboxyl group, $$R_{41}\underset{\underset{R_{43}}{|}}{CON}-,\ R_{41}\underset{\underset{R_{43}}{|}}{N}-,\ R_{41}OC\underset{\underset{R_{43}}{|}}{ON}-,$$

$$R_{43}\underset{\underset{R_{44}}{|}}{NCO}-\underset{\underset{R_{45}}{|}}{N}-\ \text{or}\ R_{41}SO_2\underset{\underset{R_{43}}{|}}{N}-.$$

$R_{58}$ has the same meaning as $R_{41}$. $R_{59}$ has the same meaning as $R_{41}$ and additionally represents $$R_{41}\underset{\underset{R_{43}}{|}}{CON}-,\ R_{41}OC\underset{\underset{R_{43}}{|}}{ON}-,\ R_{41}SO_2\underset{\underset{R_{43}}{|}}{N}-,\ R_{43}OOC-,$$

$$R_{43}\underset{\underset{R_{44}}{|}}{NCO}-\underset{\underset{R_{45}}{|}}{N}-,\ R_{43}\underset{\underset{R_{44}}{|}}{NSO_2}\underset{\underset{R_{45}}{|}}{N}-,$$

a sulfonic acid group or a salt thereof, $R_{41}O$—, $R_{41}S$—, a halogen atom or $$R_{41}\underset{\underset{R_{43}}{|}}{N}-.$$

p represents from 0 to 3. When p is a plural number, plural $R_{59}$'s may represent the same substituent or different substituents. They may be bonded to each other each in the form of a divalent group to form a cyclic structure. Examples of the divalent group for forming a cyclic structure include:

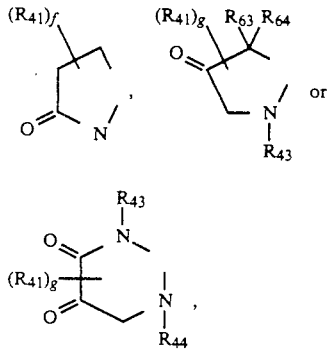

where f represents an integer of from 0 to 4 and g represents an integer of from 0 to 2. $R_{60}$ has the same meaning as $R_{41}$. $R_{61}$ has the same meaning as $R_{41}$. $R_{62}$ has the same meaning as $R_{41}$ and additionally represents $R_{41}CONH$—, $R_{41}OCONH$—, $R_{41}SO_2NH$—, a carboxyl group, a sulfonic acid group or a salt thereof, $$R_{43}\underset{R_{44}}{N}CO-\underset{R_{45}}{N}-,\ R_{43}\underset{R_{44}}{N}SO_2\underset{R_{45}}{N}-,\ R_{43}O-,\ R_{41}S-,$$

a halogen atom or $$R_{41}\underset{R_{43}}{N}-.$$

$R_{63}$ and $R_{64}$ each represents an alkyl group, or they may be bonded to each other to form a ring. h represents an integer of from 0 to 4. When the formula has plural $R_{62}$'s, they may be same or different.

The aliphatic group referred to herein means a saturated or unsaturated, chained or cyclic, linear or branched, and substituted or unsubstituted aliphatic hydrocarbon group, having from 1 to 15, preferably from 1 to 8 carbon atoms. Specifically, it includes methyl, ethyl, propyl, isopropyl, butyl, t-butyl, i-butyl, t-amyl, hexyl and cyclohexyl group.

The aromatic group is preferably a substituted or unsubstituted phenyl group having from 6 to 10 carbon atoms.

The heterocyclic group is preferably a 3-membered to 6-membered substituted or unsubstituted heterocyclic group having from 1 to 15 carbon atoms and preferably having from 1 to 5 hetero atoms selected from a nitrogen atom, an oxygen atom and a sulfur atom. specific examples of such a heterocyclic group include 2-pyridyl, 4-pyridyl, 2-thienyl, 2-furyl, 1-imidazolyl, phthalimido, 1,3,4-thiadiazol-2-yl, 2-quinolyl, tetrazolyl, 2,4-dioxo-1,3-imidazolidin-5-yl, 2,4-dioxo-1,3-imidazolidin-3-yl, succinimido, 1,2,4-triazol-2-yl and 1-pyrazolyl groups.

The above-mentioned aliphatic hydrocarbon group, aromatic group and heterocyclic group may optionally be substituted. Specifically, substituents for the groups include a halogen atom, $$R_{47}O-,\ R_{46}S-,\ R_{47}\underset{R_{48}}{N}CON-,\ R_{47}\underset{R_{48}}{N}CO-,\ R_{46}OCON-,$$

-continued

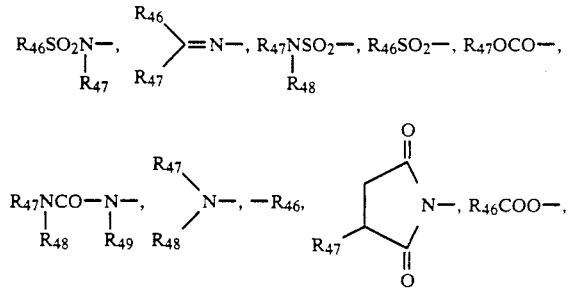

a phosphonic acid group or a salt thereof, $R_{47}OSO_2$—, a cyano group and a nitro group. $R_{46}$ represents an aliphatic group, an aromatic group or a heterocyclic group; and $R_{47}$, $R_{48}$ and $R_{49}$ each represents an aliphatic group, an aromatic group, a heterocyclic group or a hydrogen atom. The aliphatic group, aromatic group and heterocyclic group have the same meanings as those defined above.

Preferred examples of $R_{51}$ to $R_{62}$ and p and h will be mentioned below.

$R_{51}$ is preferably an aliphatic group or an aromatic group. $R_{52}$, $R_{53}$ and $R_{55}$ each are preferably an aromatic group. $R_{54}$ is preferably $R_{41}CONH$— or $$R_{41}\underset{R_{43}}{N}-.$$

$R_{56}$ and $R_{57}$ each is preferably an aliphatic group, $R_{41}O$— $R_{41}S$—. $R_{58}$ is preferably an aliphatic group or an aromatic group. In the formula (Cp-6), $R_{59}$ is preferably a chlorine atom, a fluorine atom, an aliphatic group or $R_{41}CONH$—. p is preferably an integer of from 0 to 2. $R_{60}$ is preferably an aromatic group. In the formula (Cp-7), $R_{59}$ is preferably a chlorine atom or $R_{41}CONH$—. In the formula (Cp-7), h is preferably 0 or 1. $R_{61}$ is preferably an aliphatic group or an aromatic group. In the formula (Cp-8), h is preferably 0 or 1. $R_{62}$ is preferably $R_{42}OCONH$—, $R_{41}CONH$— or $R_{41}SO_2H$—, which is preferably substituted on the 5-position of the naphthol ring.

Specific examples of the groups $R_{51}$ to $R_{62}$ will be mentioned below.

$R_{51}$ includes t-butyl, 4-methoxyphenyl, phenyl, methyl, 4-carboxyphenyl and 2-chlorophenyl groups. $R_{52}$ and $R_{53}$ each includes 3-carboxyphenyl, 3,5-dicarboxyphenyl, 2-chloro-5-methoxycarbonylphenyl, 2-chloro-5-(3-carboxypropaneamido)phenyl, 2-chloro-5-ethoxycarbonylphenyl, phenyl, 2-methoxy-5-methoxycarbophenyl and 2-pyridyl groups.

$R_{54}$ includes 3-acetamidobenzamido, benzamido, 3-phenoxypropanamidobenzamido, 3-carboxybenzamido, 2-chloro-5-ethanamidoanilino, anilino, 5-phenoxyacetamidoanilino, 3-carboxyanilino and 3,5-dicarboxyanilino groups.

$R_{55}$ includes 2,4,6-trichlorophenyl, 2-chlorophenyl, 4-carboxyphenyl, 2,5-dichlorophenyl, 4-sulfophenyl, 2,3-dichlorophenyl and 2,6-dichloro-4-carboxyphenyl groups.

$R_{56}$ includes methyl, ethyl, 2-carboxyethyl, isopropyl, propyl, methoxy, ethoxy, methylthio, phenyl, ethylthio and 3-phenylureido groups. $R_{57}$ includes 3-phenoxypropyl, t-butyl, 3-(2-methoxyethoxyphenyl)-propyl, carboxymethoxy, ethoxy, carboxymethylthio, 4-carboxyphenyl, ethylthio, methyl, carboxyethyl and phenylthio groups. $R_{58}$ includes 2-chlorophenyl, 3-carboxypropyl, 2-carboxyethyl, carboxymethyl, 3,5-dicarboxyphenyl, butyl, ethyl, methyl and furyl groups. $R_{59}$ includes chlorine and fluorine atoms, and methyl, carboxyl, ethyl, butyl, isopropyl, 2-carboxyethyl and 2-phenoxyacetamido groups. $R_{60}$ includes 4-cyanophenyl, 2-cyanophenyl, 4-methanesulfonylphenyl, 2-carboxyethyl, 4-carboxyphenyl and 3-methoxycarbonylphenyl groups. $R_{61}$ includes 2-carboxyethyl, 4-carboxyphenyl, 3,5-dicarboxy phenyl, butyl, 3-phenoxypropyl, 1-carboxymethyl, 1-carboxyethyl, 3-phenoxybutyl and 1-naphthyl groups. $R_{62}$ includes isobutyloxycarbonylamino, methanesulfonamido and acetamido groups.

Next, $LVG_1$ to $LVG_4$ will be explained hereunder.

$LVG_1$ preferably represents $R_{65}O$—, an imido group to be bonded to the coupling position via the nitrogen atom, a 5-membered or 6-membered unsaturated nitrogen-containing heterocyclic group bonded to the coupling position via the nitrogen atom, or $R_{66}S$—.

$LVG_2$ preferably represents $R_{66}S$—, $R_{65}O$, $R_{65}$—N=N— or a 5-membered or 6-membered unsaturated nitrogen-containing heterocyclic group bonded to the coupling position via the nitrogen atom.

$LVG_3$ preferably represents $R_{66}S$— or a 5-membered or 6-membered unsaturated nitrogen-containing heterocyclic group bonded to the coupling position via the nitrogen atom.

$LVG_4$ preferably represents $R_{66}O$—, $R_{65}$—N=N— or $R_{66}S$—.

$R_{65}$ represents an aromatic group or a heterocyclic group; and $R_{66}$ represents an aliphatic group, an aromatic group or a heterocyclic group. The aromatic group, heterocyclic group and aliphatic group may have the same meanings as those defined for the aforesaid group $R_{41}$. The total carbon atoms in each of $R_{65}$ and $R_{66}$ is from 10 to 40, preferably from 12 to 40.

When $LVG_1$, $LVG_2$ or $LVG_3$ represents an unsaturated nitrogen-containing heterocyclic group, the cyclic structure of the heterocyclic group includes, for example, 1-pyrazolyl, 1-imidazolyl and 1,2,4-triazolyl groups.

These heterocyclic groups may optionally be substituted, and the total carbon atoms of each group (inclusive of carbons of the substituent(s), if any) is from 10 to 40, preferably from 12 to 40. As examples of the substituents, those for the aforesaid group $R_{41}$ being a heterocyclic group may be referred to.

When $LVG_1$ represents an imido group, examples of the ring structure of the imido group include 2,4-dioxo-1,3-imidazolidin-3-yl, 2,4-dioxo-1,3-oxazolidin-3-yl, 3,5-dioxo-1,2,4-triazolidin-4-yl and octadecenylsuccinimido groups. These groups may optionally be substituted, and the total carbon atoms of each group (inclusive of carbons of substituent(s), if any) is from 10 to 40, preferably from 12 to 40. As examples of the substituents, those for the aforesaid group $R_{41}$ being a heterocyclic group may be referred to.

Specific examples of the groups $LVG_1$, $LVG_2$, $LVG_3$ and $LVG_4$ will be mentioned hereunder.

$LVG_1$ includes 1-benzyl-5-hexadecyloxy-2,4-dioxo-1,3-imidazolidin-3-yl, 1-benzyl-5,5-dioctyl-2,4-dioxo-1,3-imidazolidin-3-yl, 4-(4-hexadecyloxyphenylsulfonyl)phenoxy and 1-(3-hexadecyloxycarbonylphenyl)-tetrazolyl-5-thio groups.

$LVG_2$ includes 4-{3-(2-decyl-4-methylphenoxy)acetyloxy}propyl-1-pyrazolyl, 4-tetradecyloxyphenylazo, 2-butoxy-5-(1,1-dimethyl-3,3-dimethylbutyl)phenylthio and 4-tetradecylcarbamoylphenoxy groups.

$LVG_3$ includes 2-butoxy-5-(1,1-dimethyl-3,3-dimethylbutyl)phenylthio and 2-methoxyethoxy-5-(1,1-dimethyl-3,3-dimethylbutyl)phenylthio groups.

$LVG_4$ includes 4-(1,1-dimethyl-3,3-dimethylbutyl)-phenoxy, 4{4-(2,4-di-t-amylphenoxy)butanamido} phenoxy, 4{2-(2,4-di-t-amylphenoxy)butanamido} phenoxy, 3-(2,4-di-t-amylphenoxy)propylcarbamoylmethoxy and 4-(2,4-di-t-amylphenoxy)butylcarbamoylmethylthio groups.

Of the couplers of the formulae (Cp-1) to (Cp-8), preferred are those of the formulae (Cp-6) to (Cp-8).

The compound of the formula (IV) can be incorporated into the hydrophilic colloid by conventional methods of dispersing an image-forming coupler in a hydrophilic colloid (for example, an oil-in-water dispersion method or a polymer dispersion method). If the compound has an alkali-soluble group, it may be added to the hydrophilic colloid in the form of an aqueous solution thereof.

The amount of the compound to be used is not specifically limited but it may be, for example, from $10^{-6}$ to $10^{-1}$ mol per mol of silver halide in the emulsion layer containing the compound or in the emulsion layer adjacent to the layer containing the compound.

Specific examples of the compounds for use in the present invention are set forth below, which, however, are not limitative.

IV-(1)

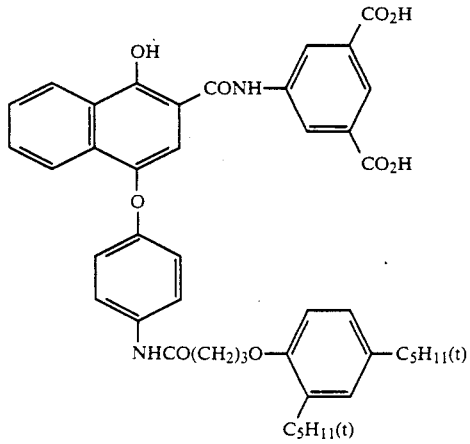

-continued
IV-(2)
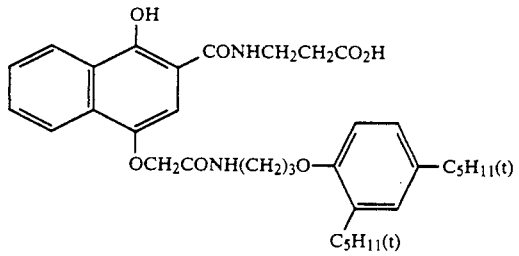
IV-(3)
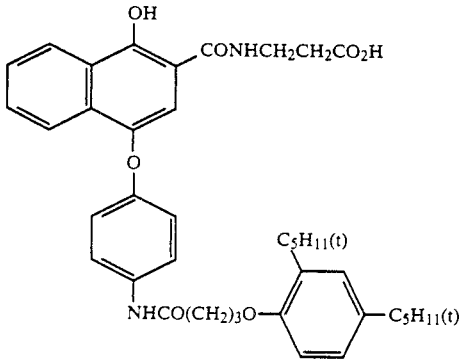
IV-(4)
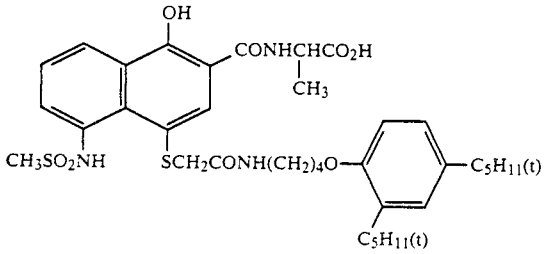
IV-(5)
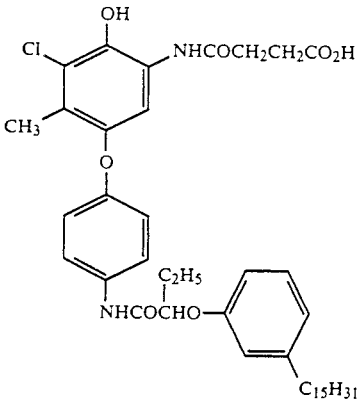
IV-(6)
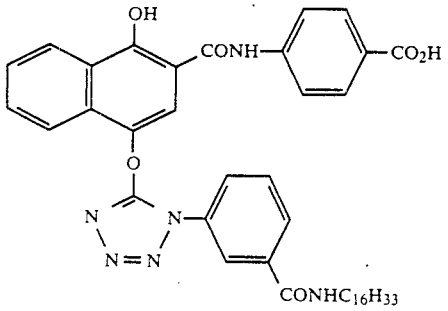

-continued
IV-(7)
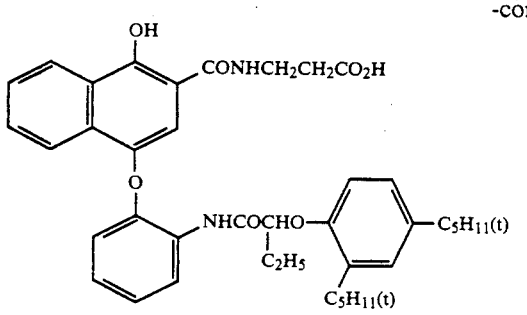
IV-(8)
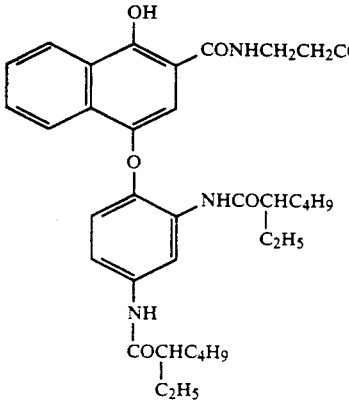
IV-(9)
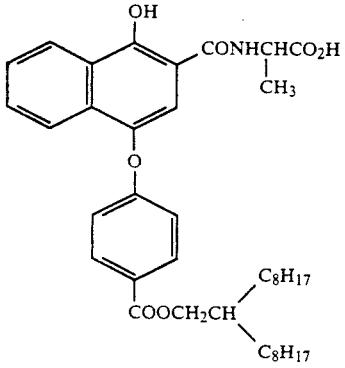
IV-(10)
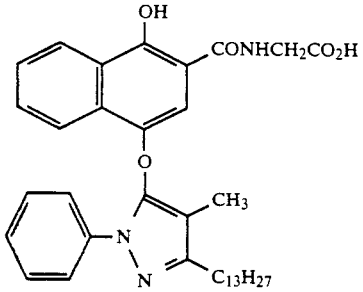
IV-(11)
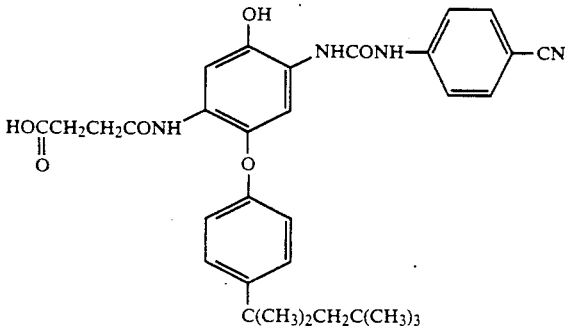

-continued
IV-(12)
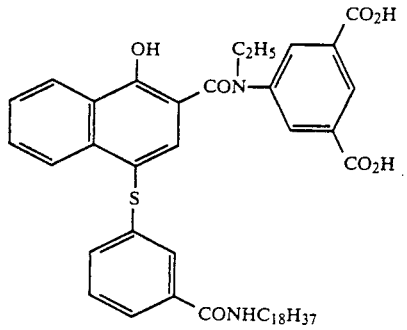
IV-(13)
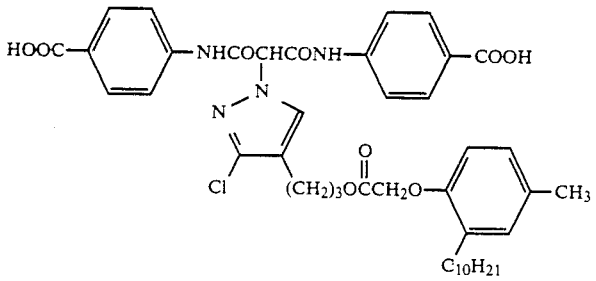
IV-(14)
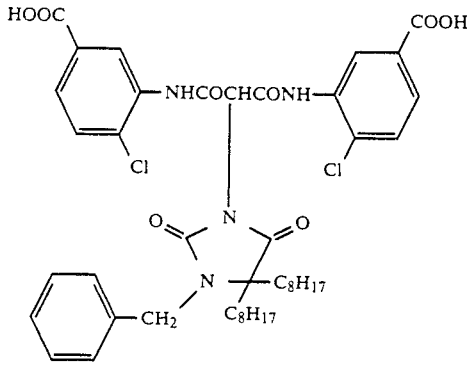
IV-(15)
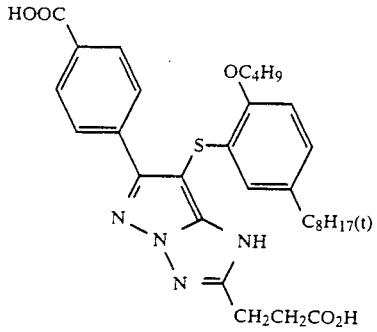
IV-(16)
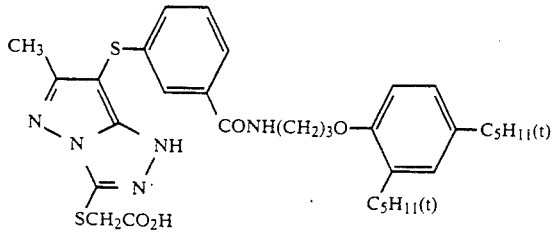

-continued
IV-(17)
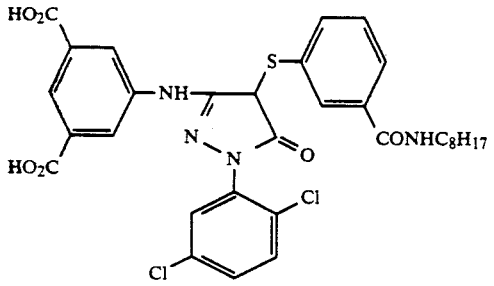
IV-(18)
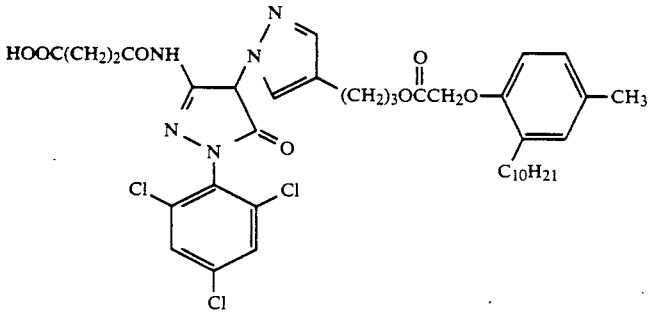
IV-(19)
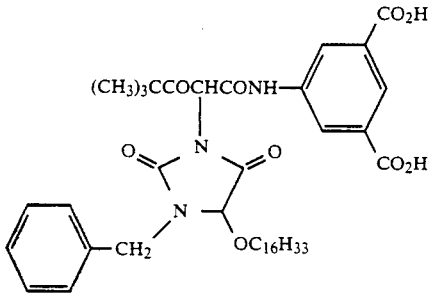
IV-(20)
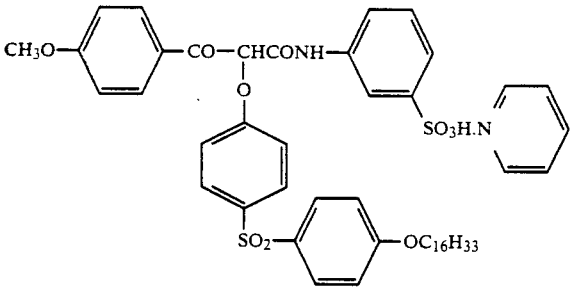
IV-(21)
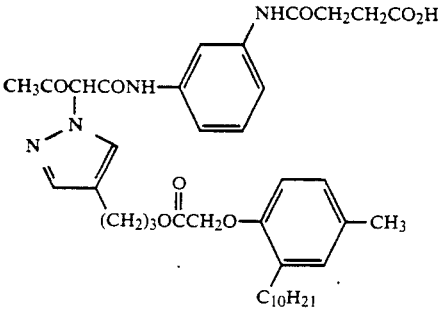

-continued
IV-(22)
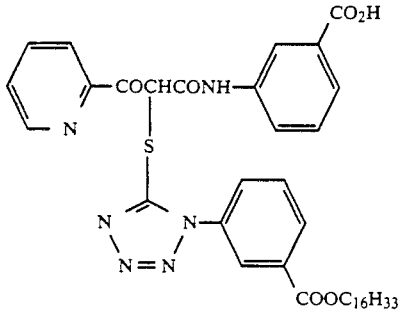
IV-(23)
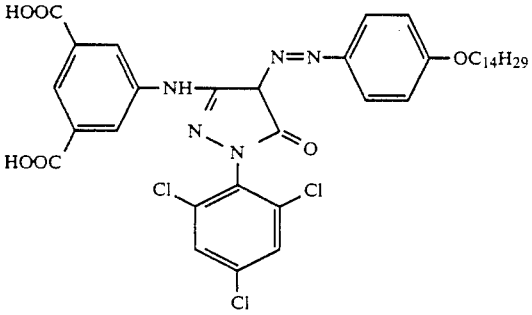
IV-(24)
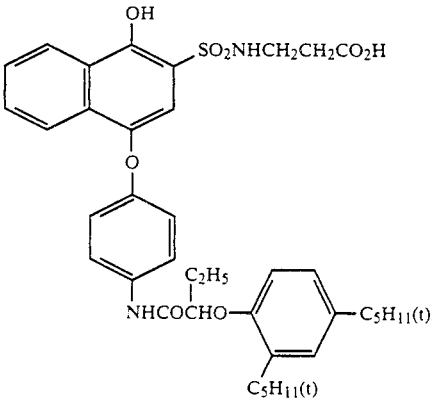
IV-(25)
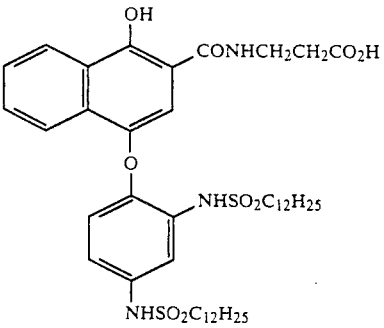
IV-(26)
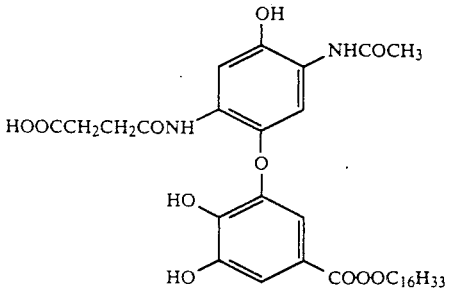
The compounds of the present invention can be prepared by a method similar to the method of producing Next, the compounds represented by the formula (V) will be explained in detail hereunder.

In the formula (V), when $A_1$ and $A_2$ are not hydrogen atoms, the compound is hydrolyzed with an alkali in development to form a compound of the following formula (V-a):

$$H—P—Ar—Q—H \qquad \text{(V-a)}$$

In the formula, P, Ar and Q have the same meanings as those defined in the formula (V). The compound of the formula (V-a) functions to reduce the oxidation product of a developing agent. In general, compounds having a reducing ability are known to conform to the Kendall-Pelz law (refer to T. H. James, *The Theory of the Photographic Process*, 4th Ed., pages 298 to 300, published by MacMillan, 1976), and the compounds of the formula (V-a) fall within the scope of the structural range of the compounds.

Of the compounds of the formula (V), preferred are those of the following formula (VII).

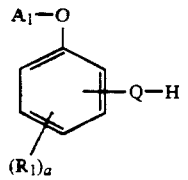

(VII)

In the formula, $A_1$ and Q have the same meanings as those defined for the formula (V); and —Q—H is positioned in 2- or 4-position to $A_1$—O— in the benzene ring. $R_1$ represents a group which may be substituted in the benzene ring; and a represents an integer of from 1 to 4. When a is 2 or more, plural $R_1$'s may be same or different. When two $R_1$'s are adjacent substituents on the benzene ring, they may be bonded to each other to form a cyclic structure.

When the two $R_1$'s are bonded to each other to form a cyclic structure, examples of such a cyclic structure include naphthalenes, benzonorbornenes, chromans and indoles. These condensed rings may further have substituent(s). Examples of the substituents for the condensed rings and preferred examples of $R_1$ not forming a condensed ring include $$R_2—,\ R_3O—,\ R_3S—,\ R_3CON(R_4)—,\ R_2SO_2N(R_3)—,\ R_2OCON(R_3)—,$$

$$R_3NCON(R_4)(R_5)—,\ R_3N(R_4)—,\ R_3NCO(R_4)—,\ R_3OOC,\ R_2SO_2—,\ R_3NSO_2(R_4)—,$$

$$R_3SO—,$$

a halogen atom, a cyano group, $$R_3OSO_2,\ R_2COO—,\ R_3NSO_2N(R_4)(R_5)— \text{ and } R_2SO—.$$

$R_2$ represents an aliphatic group, an aromatic group or a heterocyclic group; and $R_3$, $R_4$ and $R_5$ each represents an aliphatic group, an aromatic group, a heterocyclic group or a hydrogen atom. The aliphatic group, aromatic group and heterocyclic group have the same meanings as those defined above, for example for the group $R_{41}$.

The total carbon atoms in $R_1$ is preferably from 1 to 40. Especially preferably, at least one $R_1$ of plural $(R_1)$'s has total carbon atoms of 6 or more.

In the formula (VII), when $A_1$ represents a group that is cleaved by hydrolysis, it includes, for example, an acyl group (e.g., acetyl, benzoyl), an alkoxycarbonyl group (e.g., ethoxycarbonyl), an aryloxycarbonyl group (e.g., phenoxycarbonyl) as well as the precursor group to utilize the reverse Michel reaction described in U.S. Pat. No. 4,009,029 (e.g., cyanoethyl).

In the formula (VII), when Q represents a sulfonylimino group, it is preferably $$R_6SO_2—N(\ )—,$$

where $R_6$ has the same meaning as $R_2$.

In the formula (VIII), $A_1$ is especially preferably a hydrogen atom.

In the formula (VII), $R_1$ is especially preferably an aliphatic group, an acylamino group or a sulfonamido group.

Specific examples of the compounds of the formula (V) are set forth below, which, however, are not limitative.

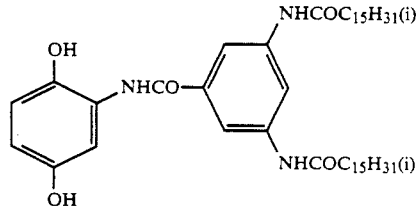

V-(1)

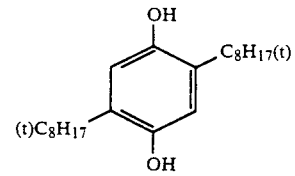

V-(2)

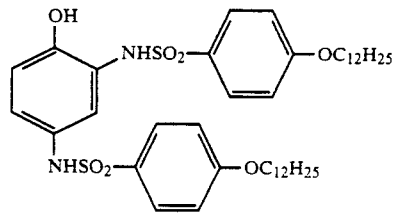

V-(3)

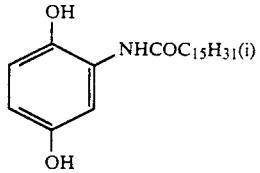

V-(4)

-continued
V-(5)
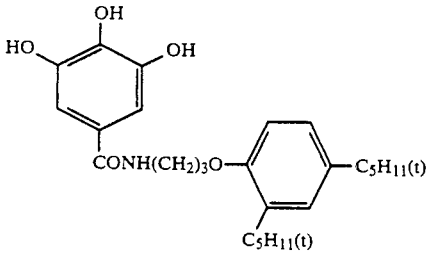
V-(6)
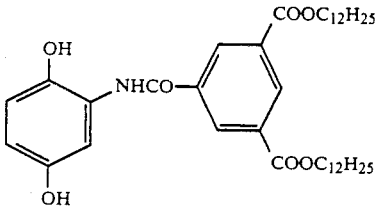
V-(7)
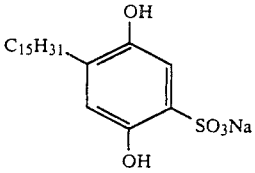
V-(8)
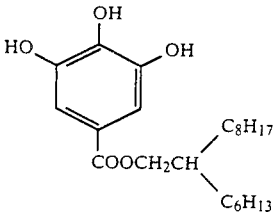
V-(9)
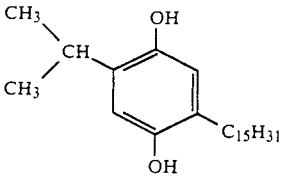
V-(10)
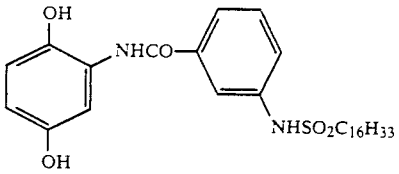
V-(11)
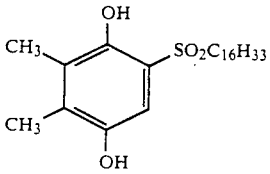
V-(12)
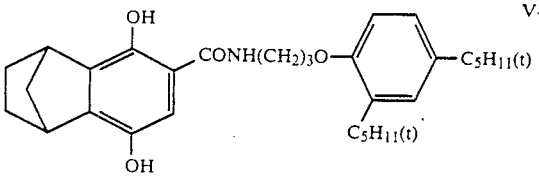
-continued
V-(13)
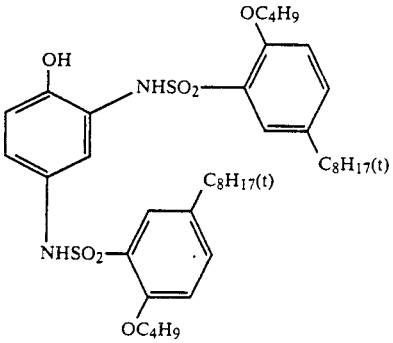
V-(14)
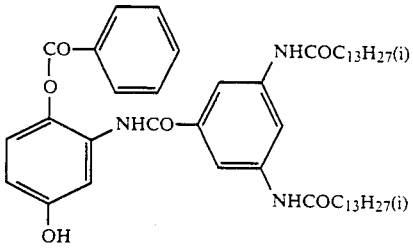
V-(15)
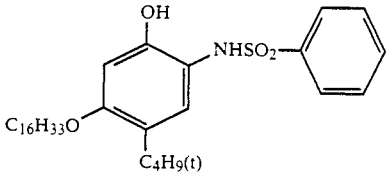
V-(16)
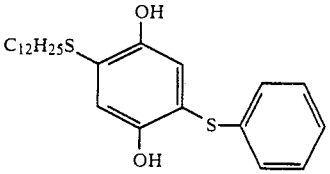
V-(17)
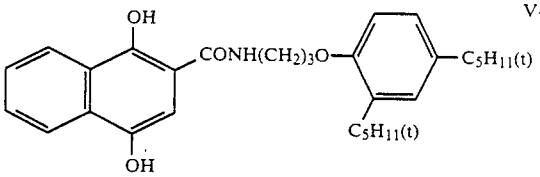
V-(18)
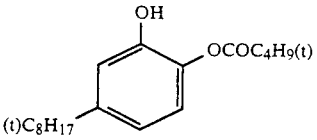
V-(19)
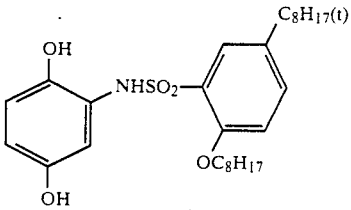

-continued

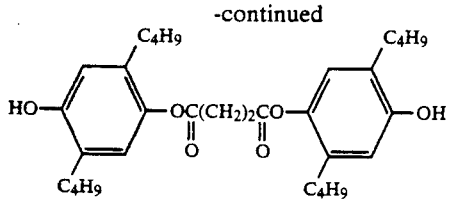

V-(20)

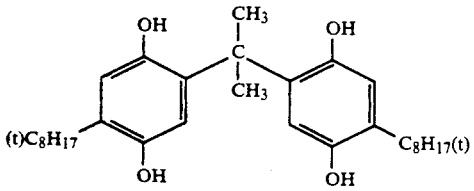

V-(21)

The high silver chloride emulsion for use in the present invention is preferably selectively spectrally sensitized to blue-sensitive, green-sensitive, red-sensitive or infrared-sensitive, with appropriate spectral sensitizing dyes, especially methine dyes such as monomethine, trimethine, pentamethine, or hexamethinecyanine dyes or merocyanine dyes. For instance, the spectral sensitizing dyes as represented by the formula (IV) mentioned in Japanese Patent Application No. 63-6861 can be used.

It is preferred that at least a part of the total amount of the spectral sensitizing dye to be added to the high silver chloride emulsion of the present invention is added during or before the step of chemical sensitization of the emulsion. For instance, the sensitizing dyes and the addition methods described in EP 273,430 are preferably employed. By addition of such spectral sensitizing dyes to the emulsion, formation of stain in the photographic materials of the present invention may further be reduced.

The photographic materials of the present invention generally contain a yellow coupler, magenta coupler and cyan coupler which may color in yellow, magenta and cyan, respectively, after being coupled with the oxidation product of an aromatic primary amine developing agent.

As yellow couplers for use in the present invention, acylacetamide derivatives such as benzoylacetanilides and pivaloylacetanilides are preferred.

In particular, the compounds represented by the following formulae (Y-1) and (Y-2) are preferred as yellow couplers for use in the invention.

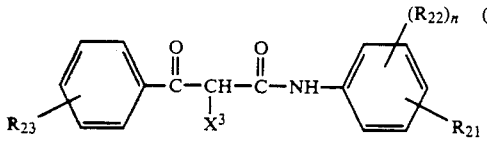

(Y-1)

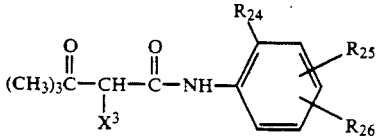

(Y-2)

In the formulae, $X^3$ represents a hydrogen atom or a coupling-releasing group; $R_{21}$ represents a non-diffusible group having total carbons of from 8 to 22; $R_{22}$ represents a halogen atom, a lower alkyl group, a lower alkoxy group and a non-diffusive group having total carbons of from 8 to 32; $R_{23}$ represents a hydrogen atom or a substituent, and when the benzene ring has two or more $R_{23}$'s, they may be same or different; n represents 0 or an integer of from 0 to 4; $R_{24}$ represents a halogen atom, an alkoxy group a trifluoromethyl group or an aryl group; $R_{25}$ represents a hydrogen atom, a halogen atom or an alkoxy group; and $R_{26}$ represents —NH-$COR_{27}$, —$NHSO_2R_{27}$, —$SO_2NHR_{27}$, —$COOR_{27}$, and $$-\mathrm{SO}\underset{\displaystyle R^{28}}{\underset{|}{\mathrm{N}}}\mathrm{R}_{27}$$

(wherein $R_{27}$ and $R_{28}$ each represents an alkyl group, an aryl group or an acyl group).

The details of pivaloylacetanilide yellow couplers are described in U.S. Pat. No. 4,622,287, from column 3, line 15 to column 8, line 39 and U.S. Pat. No. 4,623,616, from column 14, line 50 to column 19, line 41.

The details of benzoylacetanilide yellow couplers are described in U.S. Pat. Nos. 3,408,194, 3,933,501, 4,046,575, 4,133,958 and 4,401,752.

As specific examples of pivaloylacetanilide yellow couplers, there are mentioned the compounds (Y-1) to (Y-39) described in the aforesaid U.S. Pat. No. 4,622,287, from column 37 to column 54. Of these compounds, especially preferred are (Y-1), (Y-4), (Y-6), (Y-7), (Y-15), (Y-21), (Y-22), (Y-23), (Y-26), (Y-35), (Y-36), (Y-37), (Y-38) and (Y-39).

In addition, there are further mentioned the compounds (Y-1) to (Y-33) described in the aforesaid U.S. Pat. No. 4,623,616, from column 19 to column 24. Of these compounds, especially preferred are (Y-2), (Y-7), (Y-8), (Y-12), (Y-20), (Y-21), (Y-23) and (Y-29).

In addition, as other preferred compounds, there are further mentioned the compound (34) described in U.S. Pat. No. 3,408,194, the compounds (16) and (19) described in U.S. Pat. No. 3,933,501, the compound (9) described in U.S. Pat. No. 4,046,575, columns 7 to 8, the compound (1) described in U.S. Pat. No. 4,133,958, columns 5 to 6 and the compound example No. 1 described in U.S. Pat. No. 4,401,752, column 5.

Of the couplers, especially preferred are those having a nitrogen atom as a releasing group.

As magenta couplers for use in the present invention, there are mentioned oil-protect type indazolone or cyanoacetyl couplers, preferably pyrazoloazole couplers such as 5-pyrazolones and pyrazolotriazoles. Among the 5-pyrazolone couplers, those in which the 3-position is substituted by an arylamino group or an acylamino group are preferred from the viewpoint of the hue and the color density of the colored dyes. Specific examples of such couplers are described in U.S. Pat. Nos. 2,311,082, 2,343,703, 2,600,788, 2,908,573, 3,062,653, 3,152,896 and 3,936,015. As the releasing groups for the 2-equivalent 5-pyrazolone couplers, the nitrogen atom-releasing groups described in U.S. Pat. No. 4,310,619 and the arylthio groups described in U.S. Pat. No. 4,351,897 are preferred. The 5-pyrazolone couplers having a ballast group described in European Patent 73,636 are preferred as giving dyes with a high color density.

As examples of pyrazoloazole couplers for use in the present invention, there are mentioned the pyrazolobenzimidazoles described in U.S. Pat. No. 3,369,879, preferably the pyrazolo[5,1-c][1,2,4]triazoles described in U.S. Pat. No. 3,725,067, the pyrazolotetrazoles described in *Research Disclosure,* Item 24220 (June, 1984) and the pyrazolopyrazoles described in *Research Disclosure,*

Item 24230 (June, 1984). All the above-mentioned couplers may be polymer couplers.

The compounds may concretely be represented by the following general formulae (M-1), (M-2) and (M-3).

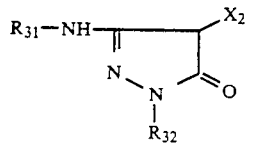
[M-1]

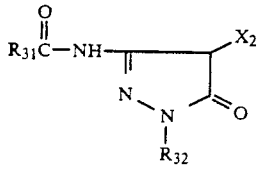
[M-2]

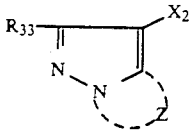
[M-3]

In the formulae, $R_{31}$ represents a non-diffusive group having total carbons of from 8 to 32; $R_{32}$ represents a phenyl group or a substituted phenyl group; $R_{33}$ represents a hydrogen atom or a substituent; Z represents a non-metallic atom group necessary for forming a 5-membered azole ring containing from 2 to 4 nitrogen atoms, and the azole ring may optionally have substituent(s) including the form of a condensed ring. $X_2$ represents a hydrogen atom or a group to be released. The details of the substituents for $R_{33}$ and those of the substituents on the azole ring are described in, for example, U.S. Pat. No. 4,540,654, from column 2, line 41 to column 8, line 27.

Among the pyrazoloazole couplers, the imidazo[1,2-b]pyrazoles described in U.S. Pat. No. 4,500,630 are preferred in view of the small yellow side-absorption of the colored dyes and of the high light-fastness thereof. In particular, the pyrazolo[1,5-b][1,2,4]triazoles described in U.S. Pat. No. 4,540,654 are especially preferred.

In addition, the pyrazolotriazole couplers where a branched alkyl group is directly bonded to the 2-, 3- or 6-position of the pyrazolotriazole ring described in JP-A-61-65245; the pyrazoloazole couplers containing a sulfonamido group in the molecule described in JP-A-61-65246; the pyrazoloazole couplers having an alkoxyphenylsulfonamido ballast group described in JP-A-61-147254; and the pyrazolotriazole couplers having an alkoxy group or an aryloxy group in the 6-position described in European Patent 226,849A are also preferably used.

As cyan couplers for use in the present invention, phenol cyan couplers and naphthol cyan couplers are most typical.

As phenol cyan couplers, there are mentioned the couplers (including polymer couplers) having an acylamino group in the 2-position of the phenol nucleus and an alkyl group in the 5-position thereof described in U.S. Pat. Nos. 2,369,929, 4,518,687, 4,511,647 and 3,772,002. As specific examples of such couplers, there are the coupler of Example 2 of Canadian Patent 625,822, the compound (1) described in U.S. Pat. No. 3,772,002, the compounds (I-4) and (I-5) described in U.S. Pat. No. 4,564,590, the compounds (1), (2), (3) and (24) described in JP-A-61-39045, and the compound (C-2) described in JP-A-62-70846.

As additional phenol couplers, there are further mentioned the 2,5-diacylaminophenol couplers described in U.S. Pat. Nos. 2,772,162, 2,895,826, 4,334,011 and 4,500,653 and JP-A-59-164555. As specific examples of such couplers, there are the compound (V) described in U.S. Pat. No. 2,895,826, the compound (17) described in U.S. Pat. No. 4,557,999, the compounds (2) and (12) described in U.S. Pat. No. 4,565,777, the compound (4) described in U.S. Pat. No. 4,124,396 and the compound (I-19) described in U.S. Pat. No. 4,613,564.

As still additional phenol cyan couplers, there are also mentioned the couplers where a nitrogen-containing hetero-ring is condensed to the phenol nucleus, as described in U.S. Pat. Nos. 4,327,173, 4,564,586 and 4,430,423, JP-A-61-390441 and JP-A-62-257158. As specific examples of such couplers, there are the couplers (1) and (3) described in U.S. Pat. No. 4,327,173, the compounds (3) and (16) described in U.S. Pat. No. 4,564,586 and the compounds (1) and (3) described in U.S. Pat. No. 4,430,423.

As further examples of phenol cyan couplers which may be used in the present invention, there are the ureido couplers described in U.S. Pat. Nos. 4,333,999, 4,451,559, 4,444,872, 4,427,767 and 4,579,813 and European Patent 067,689B1. As specific examples of such couplers, there are the coupler (7) described in U.S. Pat. No. 4,333,999, the coupler (1) described in U.S. Pat. No. 4,451,559, the coupler (14) described in U.S. Pat. No. 4,444,872, the coupler (3) described in U.S. Pat. No. 4,427,767, the couplers (6) and (24) described in U.S. Pat. No. 4,609,619, the couplers (1) and (11) described in U.S. Pat. No. 4,579,813, the couplers (45) and (50) described in European Patent 067,689B1 and the coupler (3) described in JP-A-6-142658.

As naphthol cyan couples which may be used in the present invention, those having an N-alkyl-N-arylcarbamoyl group in the 2-position of the naphthol nucleus (for example, as described in U.S. Pat. No. 2,313,586), those having an alkylcarbamoyl group in the 2-position (for example, as described in U.S. Pat. Nos. 2,474,293 and 4,282,312), those having an arylcarbamoyl group in the 2-position (for example, as described in JP-B-50-14523), those having a carbonamido or sulfonamido group in the 5-position (for example, as described in JP-A-60-237448, JP-A-61-145557, JP-A-61-153640), those having an aryloxy-releasing group in the 5-position (for example, as described in U.S. Pat. No. 3,476,563), those having a substituted alkoxy-releasing group in the 5-position (for example, as described in U.S. Pat. No. 4,296,199), and those having a glycolic acid-releasing group in the 5-position (for example, as described in JP-B-60-39217) are mentioned.

Specific examples of the couplers which may be used in the present invention are described in, for example, Japanese Patent Application No. 63-6861.

The photographic materials of the present invention can contain, as a color-fogging inhibitor, hydroquinone derivatives, aminophenol derivatives, gallic acid derivatives and ascorbic acid derivatives.

The photographic materials of the present invention can also contain various kinds of anti-fading agents. For instance, as organic anti-fading agents for cyan, magenta and/or yellow images, which can be incorporated into the photographic materials of the present invention, there may be mentioned hindered phenols such as hydroquinones, 6-hydroxychromans, 5-hydroxycoumarans, spirochromans, p-alkoxyphenols and bisphenols, and gallic acid derivatives, methylenedioxybenzenes, aminophenols and hindered amines, as well as ether or ester derivatives thereof where the phenolic hydroxyl group has been silylated or alkylated. In addition, metal complexes such as (bissalicylaldoximato)nickel complexes and (bis-N,N-dialkyldithiocarbamato)nickel complexes can also be used for the same purpose.

As specific examples of the organic anti-fading agent for use in the present invention, there are the following compounds:

Hydroquinones described in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxycoumarans and spirochromans described in U.S. Pat. Nos. 4,432,300, 3,573,050, 3,574,627, 3,698,909 and 3,764,337 and JP-A-52-152225; spiroindanes described in U.S. Pat. No. 4,360,589; p-alkoxyphenols described in U.S. Pat. No. 2,735,765, British Patent 2,066,975, JP-A-59-10539 and JP-B-57-19764; hindered phenols described in U.S. Pat. No. 3,700,455, JP-A-52-72225, U.S. Pat. No. 4,228,235 and JP-B-52-6623, gallic acid derivatives, methylenedioxybenzenes and aminophenols described in U.S. Pat. Nos. 3,457,079 and 4,332,886 and JP-B-56-21144; hindered amines described in U.S. Pat. Nos.3,336,135 and 4,268,593, British Patents 1,32,889, 1,354,313 and 1,410,846, JP-B-51-1420 and JP-A-58-114036, JP-A-59-53846 and JP-A-59-78344; phenolic hydroxyl group-etherified or esterified derivatives described in U.S. Pat. Nos. 4,155,765, 4,174,220, 4,254,216 and 4,264,720, JP-A-54-145530, JP-A-55-6321, JP-A-58-105147 and JP-A-59-10539, JP-B-57-37856, U.S. Pat. No. 4,279,990, and JP-B-53-3263; metal complexes described in U.S. Pat. Nos. 4,050,938 and 4,241,155 and British Patent 2,027,731(A).

These compounds may be co-emulsified and added into the light-sensitive layer together with the corresponding coupler, in an amount of from 5 to 100% by weight of the coupler, whereby the intended object can be attained. In order to prevent deterioration of the cyan color images because of heat, especially light, it is effective to incorporate an ultraviolet absorbent into both layers adjacent to the cyan-coloring layer.

Among the above-mentioned anti-fading agents, spiroindanes and hindered amines are especially preferred.

In accordance with the present invention, the following compounds (A) and/or (B) are preferably used together with the aforesaid couplers, especially pyrazoloazole couplers.

Specifically, compound (A) which may react with the aromatic amine developing agent remaining after color development by chemically bonding to form a chemically inactive and substantially colorless compound and/or compound (B) which may react with the oxidation product of the aromatic amine color developing agent remaining after color development by chemically bonding to form a chemically inactive and substantially colorless compound is(are) incorporated into the photographic layer of the material of the invention singly or in combination and together with the aforesaid coupler, whereby formation of stain and other undesirable side effects caused by the reaction of the remaining color developing agent or the oxidation product thereof and the coupler in the film layer to give a colored dye therein may effectively be prevented.

As preferred examples of compound (A), compounds that may react with p-anisidine at a secondary reaction rate constant (k2) of from 1.0 liter/mol·sec to $1\times10^{-5}$ liter/mol·sec (80° C., in trioctyl phosphate) are mentioned.

If the constant (k2) is larger than the above-mentioned range, the compounds themselves would be unstable and would react with gelatin or water to be decomposed. On the other hand, if the constant (k2) is smaller than the above-mentioned range, the reaction rate of the compound with the remaining aromatic amine developing agent would be low so that the object of the present invention to prevent the side effect of the remaining aromatic amine developing agent could not be attained.

More preferred examples of compound (A) are the compounds represented by the following formula (AI) or (AII).

$$R_{100}-(A)_{n2}-X_{100} \quad \text{(AI)}$$

$$R_{200}-\underset{\underset{B}{|}}{C}=Y_{100} \quad \text{(AII)}$$

In the formulae, $R_{100}$ and $R_{200}$ each represents an aliphatic group, an aromatic group or a heterocyclic group; $X_{100}$ represents a group which can react with the aromatic amine developing agent to split off; $A^1$ represents a group which can react with the aromatic amine developing agent to form a chemical bond; $n_2$ represents 0 or 1; B represents a hydrogen atom, an aliphatic group, an aromatic group, a heterocyclic group, an acyl group or a sulfonyl group; and $Y_{100}$ represents a group which promotes addition of an aromatic amine developing agent to the compound of the formula (AII). $R_{100}$ and $X_{100}$; and $Y_{100}$ and $R_{200}$ or B may be bonded to each other to form a cyclic structure.

As the reaction system for chemically bonding the compound and the remaining aromatic amine developing agent, a substitution reaction and an addition reaction are typical.

Specific examples of the compounds of the formulae (AI) and (AII) are described in Japanese Patent Application Nos. 62-158342, 62-158643, 62-212258, 62-214681, 62-228034 and 62-279843.

One characteristic feature of the present invention is provision of the colloidal silver-containing layer in the photographic material. Any conventional colloidal silver-dispersed emulsion which is generally used in picture-taking color photographic materials can be used in the present invention. For instance, the colloidal silver can be prepared in accordance with the methods described in U.S. Pat. Nos. 2,688,601 and 3,459,563 and Belgian Patent 622,695. The colloidal silver for use in the present invention is preferably fully desalted after preparation, so that it may have an electroconductivity of less than 1800 $\mu scm^{-1}$. The amount of the colloidal silver in a colloidal silver-containing layer is preferably from 0.01 to 0.5 g, especially preferably from 0.05 to 0.2 g, as silver, per $m^2$ of the photographic material. If the amount of the colloidal silver is too much, the layer would dangerously promote the defect of the photographic material of the present invention. Accordingly, it is preferred to incorporate a water-soluble dye, which will be mentioned hereunder, into the hydrophilic colloid layer of the material together with provision of such colloidal silver layer. Such dye is effective for the purpose of anti-irradiation, stabilization of the sensitivity, improvement of the safelight safety and improvement of the spectral sensitivity distribution. The dye to be used for the purpose includes, for example, oxonole dyes, hemioxonole dyes, styryl dyes, merocyanine dyes, cyanine dyes and azo dyes. Among them, especially useful are oxonole dyes, hemioxonole dyes and merocyanine dyes.

The photographic materials of the present invention can contain an ultraviolet absorbent in the hydrophilic colloid layer. For example, such ultraviolet absorbents include aryl group-substituted benzotriazole compounds (for example, those described in U.S. Pat. No. 3,533,794), 4-thiazolidone compounds (for example, those described in U.S. Pat. No. 3,314,794 and 3,352,681), benzophenone compounds (for example, those described in JP-A-46-2784), cinnamic acid ester compounds (for example, those described in U.S. Pat. Nos. 3,705,805 and 3,707,375), butadiene compounds (for example, those described in U.S. Pat. No. 4,045,229), and benzoxidole compounds (for example, those described in U.S. Pat. No. 3,700,455). In addition, ultraviolet absorbing couplers (for example, cyan dye-forming α-naphthol couplers) and ultraviolet absorbing polymers may also be used. The ultraviolet absorbent can be mordanted in a particular layer.

As the binder or protective colloid which can be used in the emulsion layer of the photographic material of the present invention, gelatin is advantageously used. In addition, other hydrophilic colloids can be used alone or in combination with gelatin.

Gelatin for use in the present invention may be either a lime-processed gelatin or an acid-processed gelatin. The details for preparing gelatin are shown in Arther Vais, *The Macromolecular Chemistry of Gelatin* (published by Academic Press, 1964).

The reflective support for use in the present invention is preferably one which can elevate the reflectivity of the material so as to enhance the sharpness of the color image formed in the silver halide emulsion layer. Such a reflective support includes a base sheet coated with a hydrophilic resin containing a light-reflective substance, such as titanium oxide, zinc oxide, calcium carbonate or calcium sulfate, dispersed in the resin, or a vinyl chloride resin base containing such a light-reflective substance dispersed therein. For instance, there may be mentioned baryta paper, polyethylene-coated paper, polypropylene synthetic paper, as well as transparent supports (for example, a glass plate, polyester film such as polyethylene terephthalate, cellulose triacetate or cellulose nitrate film or polyamide film, polycarbonate film or polystyrene film) coated with a reflective layer or containing a reflective substance therein. These supports can properly be selected in accordance with the use thereof. In addition, supports having a mirror-reflective surface or secondary diffusing reflective surface, for example those described in JP-A-60-210346 and JP-A-63-118154 and JPA-63-24247 can also be used.

The colloidal silver may be contained in an antihalation layer which is provided between the support and the silver halide emulsion layer closest to the support, and/or in a light-filter layer which is preferably provided on a red-sensitive emulsion layer. In the present invention, it is preferred that yellow colloidal silver is incorporated into the light-filter layer and black colloidal silver is incorporated into the antihalation layer.

The high silver chloride photographic materials of the present invention, which have the aforesaid reflective support, may have, for example, the following layer constitutions.

(1) PL || RL || GL || BL || AH || Support
(2) PL || GL || RL || BL || AH || Support
(3) PL || BL || GL || RL || AH || Support
(4) PL || BL || RL || GL || AH || Support
(5) PL || BL || FL || GL || RL || AH || Support
(6) PL || BL || GL || FL || RL || AH || Support In the layer constitutions, PL means a protective layer, RL means a red-sensitive emulsion layer, GL means a green-sensitive emulsion layer, BL means a blue-sensitive emulsion layer, AH means an antihalation layer, FL means a light-filter layer. An interlayer containing, for example, a mercaptoazole compound or an interlayer containing an ultraviolet absorbent or a dye may be provided between the constituent layers (where shown by ||). BL, GL and RL may be composed of two or more emulsion layers each having a different sensitivity or spectral sensitivity. In addition, the photographic material may also be composed of any other desired combinations, for example, comprising a green-sensitive layer, a red-sensitive layer and an infrared-sensitive layer. The light-filter layer functions to correct the spectral sensitivity distribution or has an antihalation function The layer can be formed, for example, by incorporating a dye into the layer.

The present invention is preferably applied to preparation of color printing photographic materials such as color photographic paper as well as to preparation of silver halide color recording materials, for example, those for recording digital information.

Next, the step of developing the photographic materials of the present invention will be explained.

Color Development:

The color developer to be used for processing the photographic materials of the present invention contains a known aromatic primary amine color developing agent. Preferred examples of the agent are p-phenylenediamine derivatives, and specific examples thereof are mentioned below, which, however, are not limitative.

D-1: N,N-diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-methyl-4[N-ethyl-N-(β-hydroxyethyl-)amino]aniline
D-6: 4-Amino-3-methyl-N-ethyl-N-[β-(methanesulfonamido)ethyl]aniline
D-7 N-(2-amino-5-diethylaminophenylethyl)methanesulfonamide
D-8 N,N-dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline The p-phenylenediamine derivatives may also be in the form of salts such as sulfates, hydrochlorides, sulfites or p-toluenesulfonates. The amount of the aromatic primary amine developing agent to be used in the color developer is preferably from about 0.1 g to about 20 g, more preferably from about 0.5 g to about 10 g or so, per liter of the developer.

The color developer for use in the present invention can further contain, if desired, sulfites, such as sodium sulfite, potassium sulfite, sodium bisulfite, potassium bisulfite, sodium metasulfite or potassium metasulfide, as well as carbonylsulfite adducts, as a preservative. However, the content of the sulfite ion in the color developer is preferably smaller, so that the developer may have a higher coloring capacity.

As compounds capable of directly preserving the aforesaid color developing agents, various hydroxylamines, the hydroxamic acids described in JP-A-63-43138, the hydrazines and hydrazides described in Japanese Patent Application No. 61-170756, the phenols described in JP-A-63-44657 and JP-A-63-58443, the α-hydroxyketones and α-aminoketones described in JP-A-63-44656 and/or various saccharides described in JP-A-63-36244 are preferably added to the color developer. Further, in combination with the compounds, the monoamines described in JP-A-63-4235, JP-A-63-24254, JP-A-63-21647, EP 254280 and EP 266797, JP-A-63-27841 and JP-A-63-25654, the diamines described in JP-A-63-30845, EP-254280 and EP 66797 and JP-A-63-43139, the polyamines described in JP-A-63-21647 and JP-A-63-26655, the polyamines described in JP-A-63-44655, the nitroxy radicals described in JP-A-63-53551, the alcohols described in JP-A-63-43139 and P-A-63-53549, the oximes described in JP-A-56654 and the tertiary amines described in EP 54280 and EP 266797 may preferably be used.

As other preservatives which may be used in the present invention, there are preferably mentioned various metals described in JP-A-57-44148 and JP-A-57-3749, the salicylic acids described in JP-A-59-180588, the alkanolamines described in JP-A-54-3532, the polyethyleneimines described in JP-A-56-94349 and the aromatic polyhydroxy compounds described in U.S. Pat. No. 3,746,544. In particular, aromatic polyhydroxy compounds, triethanolamines and the compounds described in EP 254280 and EP 255797 are especially preferably used.

The color developer for use in the present invention preferably has a pH value of from 9 to 12, more preferably from 9 to 11.0, and the color developer can contain various known developer components in addition to the above-mentioned ingredients.

In order to maintain the pH value, the color developer preferably contains various kinds of buffers. The buffers which are usable include, for example, carbonic acid salts, phosphoric acid salts, boric acid salts, tetraboric acid salts, hydroxy-benzoic acid salts, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, tris-hydroxyaminomethane salts, lysine salts, etc. In particular, carbonic acid salts, phosphoric acid salts, tetraboric acid salts and hydroxybenzoic acid salts are advantageous in that they are excellent in solubility and have an excellent buffering capacity in a high pH range of pH 9.0 or more. Therefore even when these are added to the color developer, these do not have any bad influence on the photographic properties (for example, fog, etc.). In addition, they are inexpensive. Accordingly, the use of these buffers is especially preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, these compounds are not limitative.

The amount of the buffer to be added to the color developer is preferably 0.1 mol/liter or more, and is especially preferably from 0.1 mol/liter to 0.4 mol/liter.

In addition, the color developer may further contain various chelating agents as an agent for inhibiting precipitation of calcium or magnesium in the developer or for the purpose of improving the stability of the developer.

As the chelating agent, preferred are organic acid compounds. For example, there may be mentioned the aminopolycarboxylic acids described in JP-B-48-30496 and JP-B-44-30232, the organic phosphonic acids described in JP-A-56-97347, JP-B-56-39359 and West German Patent 2,227,639, the phosphonocarboxylic acids described in JP-A-52-102726, JP-A-53-42730, JP-A-54-121127, JP-A-55-126241 and JP-A-55-659506 as well as the compounds described in JP-A-58-195845 and JP-A-58-203440 and JP-B-53-40900. Specific examples of the compounds, which are usable as a chelating agent, are mentioned below, but these are not limitative.

Nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycolether-diaminetetraacetic acid, ethylenediamineorthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid.

These chelating agents can be added to the color developer in combinations of two or more, if desired.

The amount of the chelating agent to be added may be such that could sufficiently sequester the metal ions from the color developer. For example, it is from 0.1 g to 10 g or so, per liter of developer.

The color developer may contain any optional development accelerator, if desired. However, it is preferred that the color developer to be used for processing the photographic materials of the present invention does not substantially contain benzyl alcohol, in view of prevention of environmental pollution, ease of preparation of the developer solution and prevention of color stain. The wording "does not substantially contain benzyl alcohol" means that the content of benzyl alcohol in the developer is 2 ml/liter or less, preferably 0.5 ml/liter or less, and especially preferably the developer contains no benzyl alcohol.

In accordance with the present invention, the photographic materials are processed with a substantially benzyl alcohol-free color developer within a period of 90 seconds, whereby a large effect can be attained.

As the other development accelerators which can be added to the color developer for use in the present invention, there may be mentioned, for example, the thioether compounds described in JP-B-37-16088, JP-B-37-5978, JP-B-38-7826, JP-B-44-12380 and JP-B-45-9019 and U.S. Pat. No. 3,813,247, the p-phenylenediamine compounds described in JP-A-52-49829 and JP-A-

50-15554, the quaternary ammonium salts described in JP-A-50-137726, JP-B-44-30074, JP-A-56-156826 and JP-A-52-43429, the amine compounds described in U.S. Pat. Nos. 2,494,903, 3,128,182, 4,230,796 and 3,253,919, JP-B-41-11431 and U.S. Pat. Nos. 2,482,546, 2,596,926 and 3,582,346, the polyalkylene oxides described in JP-B-37-16088 and JP-B-42-25201, U.S. Pat. No. 3,128,183, JP-B-41-11431 and JP-B-42-23883 and U.S. Pat. No. 3,532,501, as well as 1-phenyl-3-pyrazolidones and imidazoles. These compounds can be used, if desired.

In accordance with the present invention, any optional anti-foggant can be added to the color developer, if desired. As the anti-foggant there can be used alkali metal halides such as sodium chloride or potassium iodide, as well as organic anti-foggants. As specific examples of organic anti-foggants which may be used in the present invention, there are nitrogen-containing heterocyclic compounds such as benzotriazole, 6-nitrobenzimidazole, 5-nitrosoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindolidine and adenine. However, it is preferred that the color developer to be used for processing the photographic materials of the present invention does not substantially contain any bromide. The wording "does not substantially contain any bromide" means that the content of bromide in the developer is preferably 0.0025 mol/liter or less, and especially preferably the developer contains no bromide.

The color developer for use in the present invention preferably contains a brightening agent. As the brightening agent 4,4'-diamino-2,2'-disulfostylbene compounds are preferred. The amount of the brightening agent to be added to the color developer is up to 5 g/liter, preferably from 0.1 to 4 g/liter.

In addition, various kinds of surfactants can be added to the color developer if desired, including alkylsulfonic acids, arylsulfonic acids, aliphatic carboxylic acids, aromatic carboxylic acids, etc.

The processing temperature of the color developer of the present invention is from 20° to 50° C., preferably from 30° to 40° C. The processing time is not more than 90 seconds, preferably not more than 60 seconds, and more preferably not more than 45 seconds. The amount of the replenisher is preferably small and is, for example, from 20 to 600 ml, preferably from 50 to 300 ml, more preferably from 100 to 200 ml, per $m^2$ of the photographic material being processed.

Next, the desilvering step in the process of the present invention will be explained. For the desilvering step, anyone of bleaching step/fixation step; fixation step/-bleach-fixation step; bleaching step/bleach-fixation step; and bleach-fixation step can be employed. In accordance with the present invention, the time for the desilverinq step is preferably smaller, whereby the effect of the present invention is more remarkable. That is, the time for the desilvering step is 2 minutes or less, more preferably from 15 seconds to 60 seconds.

Desilvering Step:

The bleaching solution, bleach-fixing solution and fixing solution which are used in the desilvering step in the process of the present invention will be explained hereunder.

Any and every bleaching agent can be used in the bleaching solution or bleach-fixing solution for use in the present invention. In particular, organic complex salts of iron(III) (for example, complex salts with aminopolycarboxylic acids such as ethylenediaminetetraacetic acid or diethylenetriaminepentaacetic acid, or with aminopolyphosphonic acids, phosphonocarboxylic acids or organic phosphonic acids) or organic acids such as citric acid, tartaric acid or malic acid; persulfates; and hydrogen peroxide are preferred as the bleaching agent.

Among them, the organic complex salts of iron(III) are especially preferred in view of the rapid processability thereof and of the prevention of environmental pollution. Examples of the aminopolycarboxylic acids, aminopolyphosphonic acids or organic phosphonic acids or their slats which are useful for formation of organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycoletherdiaminetetraacetic acid.

These compounds may be in any form of their sodium, potassium, lithium or ammonium salts. Among these compounds, iron(III) complex salts of ethylenediaminetetraacetic acid, diethylenetriaminepentaacetic acid, cylohexanediaminetetraacetic acid, 1,3-diaminopropanetetraacetic acid or methyliminodiacetic acid are especially preferred, as these have a high bleaching capacity.

These ferric complex salts can be used in the form of the complex salts themselves, or alternatively, a ferric salt, such as ferric sulfate, ferric chloride, ferric nitrate, ferric ammonium sulfate or ferric phosphate, and a chelating agent, such as aminopolycarboxylic acids, aminopolyphosphonic acids or phosphonocarboxylic acids, can be added to a solution so that the intended ferric complex salt can be formed in the solution. The chelating agent can be used in an excess amount exceeding the necessary amount for the formation of the ferric complex salt. Among the iron complexes, the aminopolycarboxylic acid/iron complexes are preferred, and the amount of the complex to be added to the developer is from 0.01 to 1.0 mol/liter, preferably from 0.05 to 0.50 mol/liter.

In the bleaching or bleach-fixing solution and/or the previous bath thereof, various kinds of compounds can be incorporated as a bleaching accelerating agent. For example, the mercapto group- or disulfido group-containing compounds described in U.S. Pat. No. 3,893,858, West German Patent 1,290,812, JP-A-53-95630 and *Research Disclosure*, Item 17129 (July, 1978); the thiourea compounds described in JP-B-45-8506, JP-A-52-20832 and JP-A-53-32735 and U.S. Pat. No. 3,706,561; as well as halides such as iodides or bromides are preferred as having an excellent bleaching capacity.

In addition, the bleaching or bleach-fixing solution for use in the present invention can further contain a rehalogenating agent such as bromides (e.g., potassium bromide, sodium bromide ammonium bromide), chlorides (e.g., potassium chloride, sodium chloride, ammonium chloride) or iodides (e.g., ammonium iodide). Also, this can additionally contain one or more inorganic acids, organic acids or alkali metal salts or ammonium salts thereof having a pH buffering capacity, such as boric acid, borax, sodium metaborate, acetic acid, sodium acetate, sodium carbonate, potassium carbonate, phosphorus acid, phosphoric acid, sodium phosphate, citric acid, sodium citrate or tartaric acid, as well as an anti-corrosive agent such as ammonium nitrate or guanidine, if desired.

The fixing agent to be used in the bleach-fixing solution or fixing solution for use in the present invention may be a known fixing agent which is a water-soluble silver halide-dissolving agent, such as thiosulfates (e.g., sodium thiosulfate, ammonium thiosulfate); thiocyanates (e.g., sodium thiocyanate, ammonium thiocyanate); or thioether compounds and thiourea compounds (e.g., ethylene-bisthioglycolic acid, 3,6-dithia-1,8-octanediol). These can be used singly or in the form of a mixture of two or more. In addition, a special bleach-fixing solution comprising the combination of a fixing agent and a large amount of a halide such as potassium iodide, as described in JP-A-55-155354, can also be used in the present invention. In the practice of the present invention, the use of thiosulfates, especially ammonium thiosulfate, is preferred. The amount of the fixing agent in the solution is preferably from 0.3 to 3 mols, more preferably from 0.5 to 1.0 mol, per liter of the solution. The pH range of the bleach-fixing solution or fixing solution is preferably from 3 to 10, more preferably from 5 to 9.

The bleach-fixing solution can further contain other various kinds of brightening agents, defoaming agents, surfactants and polyvinyl pyrrolidone as well as organic solvents such as methanol.

The bleach-fixing solution or fixing solution for use in the present invention contains, as a preservative, a sulfite ion-releasing compound, such as sulfites (e.g., sodium sulfite, potassium sulfite, ammonium sulfite), bisulfites (e.g., ammonium bisulfite, sodium bisulfite, potassium bisulfite) or metabisulfites (e.g., potassium metabisulfite, sodium metabisulfite, ammonium metabisulfite). The compound can be incorporated into the said solution in an amount of from about 0.02 to about 0.50 mol/liter, more preferably from 0.04 to 40 mol/liter, as the sulfite ion.

As the preservative, the addition of the sulfites is the general practice, but other ascorbic acids, carbonyl-bisulfite adducts or carbonyl compounds can also be added.

In addition, a buffer, a brightening agent, a chelating agent, a defoaming agent and a fungicide can also be added to the solution, if desired.

Rinsing in Water and/or Stabilization:

In accordance with the present invention, the photographic material is, after being desilvered, for example by fixation or bleach-fixation, generally rinsed in water and/or stabilized.

The amount of the water to be used in the rinsing step can be set in a broad range, in accordance with the characteristics of the photographic material being processed (for example, depending upon the raw material components, such as the coupler) or the use of the material, as well as the temperature of the rinsing water, the number of rinsing tanks (the number of rinsing stages), the replenishment system of normal current or countercurrent and other various conditions. Among the conditions, the relation between the number of rinsing tanks and the amount of rinsing water in a multi-stage countercurrent rinsing system can be obtained by the method described in *Journal of the Society of Motion Picture and Television Engineers,* Vol. 64, pages 248 to 253 (May, 1955). In general, the number of the stages in the multi-stage countercurrent rinsing system is preferably from 2 to 6, especially from 2 to 4.

According to the multi-stage countercurrent system, the amount of rinsing water to be used can be reduced noticeably, and for example, it may be from 0.5 liter to one liter or less per $m^2$ of the photographic material being processed. Therefore, the effect of the present invention is remarkable in such a system. However, because of the prolongation of the residence time of the water in the rinsing tank, bacteria would propagate in the tank so that the floating substances generated by the propagation of bacteria would adhere to the surface of the material being processed. Accordingly, the system would often have a problem. In the practice of the present invention for processing color photographic materials, the method of reducing calcium and magnesium, which is described in JP-A-62-288838, can extremely effectively be used for overcoming the problem. In addition, the isothiazolone compounds and thiabendazoles described in JP-A-57-8542; chlorine-containing bactericides such as the chlorinated sodium isocyanurates described in JP-A-61-120145; the benzotriazoles described in JP-A-61-267761; copper ion; and other bactericides or fungicides described in H. Horiguchi, *Chemistry of Bactericidal and Fungicidal Agents,* and *Bactericidal and Fungicidal Techniques to Microorganisms,* edited by Association of Sanitary Technique, Japan, and *Encyclopedia of Bactericidal and Fungicidal Agents,* edited by Nippon Bactericide and Fungicide Association can also be used.

In addition, a surfactant, as a water-cutting agent, as well as a chelating agent such as EDTA, as a water softener, can also be added to the rinsing water.

Following the rinsing step, the material can be processed with a stabilizing solution, or alternatively, the material can directly be processed with a stabilizing solution without the rinsing step. To the stabilizing solution can be added a compound having an image stabilizing function. For example, aldehyde compounds such as formalin, buffers for adjusting to the film pH value suitable for dye stabilization as well as ammonium compounds can be added to the stabilizing solution. In addition, the above-mentioned various kinds of bactericides and fungicides can also be added to the stabilizing solution so as to prevent the propagation of bacteria in the solution or to impart a fungicidal capacity to the photographic material processed.

Further, a surfactant, a brightening agent and a hardener can also be added to the stabilizing solution. In the practice of the present invention, when the stabilization step is directly carried out without the water-rinsing step, any and every known method, for example, the methods described in JP-A-57-8543, JP-A-58-14834 and JP-A-60-220345 can be utilized.

In addition, a chelating agent such as 1-hydroxyethylidene-1,1-diphosphonic acid or ethylenediaminetetramethylenephosphonic acid, as well as a magnesium or bismuth compound can also be used as a preferred embodiment.

A so-called conventional rinsing solution can also be used as a water-rinsing solution or the stabilizing solution after the desilvering step in the same manner as the latter.

In the rinsing step or stabilization step of the present invention, the pH value of the solution is from 4 to 10, preferably from 5 to 8. The temperature of the solution can be set variously in accordance with the characteristic and the use of the photographic material as being processed, and in general, it is from 15° to 45° C., preferably from 20° to 40° C.

The following examples illustrate color photographic papers as one embodiment of the printing photographic materials of the present invention, and these are intended to explain the present invention more concretely but not to limit it in any way.

EXAMPLE 1

Preparation of Colloidal Silver Emulsion 2 g of anhydrous sodium carbonate was added to 1 kg of aqueous 10% gelatin solution and, while being kept warm at 45° C., 500 cc of aqueous 10% silver nitrate solution was added thereto. Then 1000 cc of aqueous solution containing 35 g of anhydrous sodium sulfite and 25 g of hydroquinone was added thereto over a period of 10 minutes. After being allowed to stand as such for 10 minutes, about 100 cc of 1N sulfuric acid was added so that the resulting mixture was adjusted to have a pH of 5.0. The colloidal silver sol thus obtained was cast into a cooling dish and fully gelled and then cut into noodles. These were washed with a cold water for 6 hours and fully desalted.

The thus obtained colloidal silver emulsion was stored under cooling. When used, this was heated and melted and used as an anti-halation layer. The colloidal silver emulsion was coated on a transparent support in an amount of 0.15 g/m$^2$ as silver and dried. The density of the thus coated sample was determined, and the transmission density in the range of visible rays was from 0.6 to 0.7.

An yellow colloidal silver emulsion may also be obtained in the same manner as above, by varying the condition for reducing the silver nitrate.

Preparation of Silver Halide Emulsion 6.4 g of sodium chloride was added to an aqueous 3% solution of lime-processed gelatin, and 3.2 ml of N,N'-dimethylimidazolidine-2-thione (aqueous 1% solution) was added thereto. An aqueous solution containing 0.2 mol of silver nitrate and an aqueous solution containing 0.04 mol of potassium bromide and 0.16 mol of sodium chloride were added to the resulting solution with vigorous stirring at 52° C. and blended. Subsequently, an aqueous solution containing 0.8 mol of silver nitrate and an aqueous solution containing 0.16 mol of potassium bromide and 0.64 mol of sodium chloride were added thereto with vigorous stirring at 52° C. and blended. One minute after completion of the addition of the aqueous silver nitrate solution and the aqueous alkali halide solution, 60.0 mg of 2-[2,4-(2,2-dimethyl-1,3-propano)-5-(6-methyl-3-pentylbenzothiazolin-2-ylidene)-1,3-ethyl-6-methylbenzothiazolium iodide was added. After being kept at 52° C. for 15 minutes, the resulting emulsion was desalted and washed with water. Next, 90.0 g of lime-processed gelatin and triethylthiourea were added thereto and the emulsion was optimally chemically sensitized to obtain a surface latent image type emulsion. The thus obtained silver chlorobromide emulsion (silver bromide content: 20 mol %) was called emulsion (A).

Next, 3.3 g of sodium chloride was added to an aqueous 3% solution of lime-processed gelatin, and 3.2 ml of N,N'-dimethylimidazolidin-2-thione (aqueous 1% solution) was added thereto. An aqueous solution containing 0.2 mol of silver nitrate and an aqueous solution containing 0.004 mol of potassium bromide and 0.196 mol of sodium chloride were added to the resulting solution with vigorous stirring at 52° C. and blended. Subsequently, an aqueous solution containing 0.8 mol of silver nitrate and an aqueous solution containing 0.016 mol of potassium bromide and 0.784 mol of sodium chloride were added thereto with vigorous stirring at 52° C. and blended. One minute after completion of the addition of the aqueous silver nitrate solution and the aqueous alkali halide solution, 60.0 mg of 2-[2,4-(2,2-dimethyl-1,3-propano)-5-(6-methyl-3-pentylbenzothiazolin-2-ylidene)-1,3-pentadienyl]-3-ethyl-6-methylbenzothiazolium iodide was added. After being kept at 52° C. for 15 minutes, the resulting emulsion was desalted and washed with water. Next, 90.0 g of lime-processed gelatin and triethylthiourea were added thereto and the emulsion was optimally chemically sensitized to obtain a surface latent image type emulsion. The thus obtained silver chlorobromide emulsion (silver bromide content: 2 mol %) was called emulsion (B).

Next, 3.3 g of sodium chloride was added to an aqueous 3% solution of lime-processed gelatin, and 3.2 ml of N,N'-dimethylimidazolidine-2-thione (aqueous 1% solution) was added thereto. An aqueous solution containing 0.2 mol of silver nitrate and an aqueous solution containing 0.2 mol of sodium chloride were added to the resulting solution with vigorous stirring at 52° C. and blended. Subsequently, an aqueous solution containing 0.75 mol of silver nitrate and an aqueous solution containing 0.75 mol of sodium chloride were added thereto with vigorous stirring at 52° C. and blended. One minute after completion of the addition of the aqueous silver nitrate solution and the aqueous sodium chloride solution, 60.0 mg of 2-[2,4-(2,2-dimethyl-1,3-propano)-5-(6-methyl-3-pentylbenzothiazolin-2-ylidene)-l,3-pentadienyl]-3-ethyl-6-methylbenzothiazolium iodide was added. After the emulsion was kept at 52° C. for 15 minutes, an aqueous solution containing 0.05 mol of silver nitrate and an aqueous solution containing 0.02 mol of potassium bromide and 0.03 mol of sodium chloride were added thereto with vigorous stirring at 40° C. and blended. Then the resulting emulsion was desalted and washed with water. Next, 90.0 g of lime-processed gelatin and triethylthiourea were added thereto, and the emulsion was optimally chemically sensitized to obtain a surface latent image type emulsion. The thus obtained silver chlorobromide emulsion (silver bromide: 2 mol %) was called emulsion (C).

Next, 3.3 g of sodium chloride was added to an aqueous 3% solution of lime-processed gelatin, and 3.2 ml of N,N'-dimethylimidazolidine-2-thione (aqueous 1% solution) was added thereto. An aqueous solution containing 0.2 mol of silver nitrate and an aqueous solution containing 0.2 mol of sodium chloride were added to the resulting solution with vigorous stirring at 52° C. and blended. Subsequently, an aqueous solution containing 0.775 mol of silver nitrate and an aqueous solution containing 0.775 mol of sodium chloride were added thereto with vigorous stirring at 52° C. and blended. One minute after completion of the addition of the aqueous silver nitrate solution and the aqueous sodium chloride solution, 60.0 mg of 2-[2,4-(2,2-dimethyl-1,3-propano)-5-(6-methyl-3-pentylbenzothiazolin-2-ylidene)-1,3-pentadienyl]-3-ethyl-6-methylbenzothiazolium iodide was added. After the emulsion was kept at 52° C. for 15 minutes, an aqueous solution containing 0.025 mol of silver nitrate and an aqueous solution containing 0.02 mol of potassium bromide and 0.005 mol of sodium chloride were added thereto with vigorous stirring at 40° C. and blended. Then the resulting emulsion was desalted and washed with water. Next, 90.0 g of lime-processed gelatin and triethylthiourea were added thereto, and the emulsion was optimally chemically sensitized to obtain a surface latent image type emulsion. The thus obtained silver chlorobromide emulsion (silver bromide: 2 mol %) was called emulsion (D).

Emulsion (E) was prepared in the same manner as emulsion (D),. except that 0.04 mg of ammonium hexachlororhodate(III) monohydrate and 2.0 mg of potassium hexacyanoferrate(II) trihydrate were added to the aqueous sodium chloride solution to be added in the second time, and 1.0 mg of potassium hexachloroiridate(IV) was added to the aqueous alkali halide solution to be added in the third time.

Each of the thus prepared five kinds of silver halide emulsions (A) to (E) was electromicroscopically photographed, and the shape of the grains, the grain size and the grain size distribution were obtained from the respective photographs. As a result, the silver halide grains contained in all of the emulsions (A) to (E) were found to be cubic. The grain size was expressed by the mean value of the diameter of the circle which is equivalent to the projected area of the grain; and the grain size distribution was expressed by the value obtained by dividing the standard deviation of the grain size by the mean grain size.

Next, the respective silver halide crystals were subjected to X-ray diffraction, whereby the halogen composition of the emulsion grains was determined. A monochromaticized CuKα ray was used as a ray source. The diffraction angle of the diffraction ray from a (200) plane was determined in detail. The diffraction ray from a crystal having a uniform halogen composition gave a single peak, while the diffraction ray from a crystal having a locallized phase with different halogen compositions gave plural diffraction pattern corresponding to the different halogen compositions. From the diffraction angle of the diffraction pattern measured, the lattice constant is calculated whereby the halogen composition of the silver halide constituting the crystal was determined. The results obtained are shown in Table 1 below.

Emulsion (F) was prepared in the same manner as emulsion (E), except that the temperature in formation of the silver halide grains and the time required for adding the aqueous silver nitrate solution and aqueous alkali halide solution were varied. The grain size of the emulsion (F) was 1.03μ. In preparation of emulsion (F), the amount of potassium hexacyanoferrate(II) trihydrate added was 0.4 mg, the amount of potassium hexachloroiridate(IV) was 0.12 mg, ammonium hexachlororhodate(III) monohydrate was not added, and 172.8 mg of triethylammonium 3-{2-[5-chloro-3-(3-sulfonatopropyl)benzothiazolin-2-ylidenemethyl]-3-naphtho[1,2-d]thiazolio}propanesulfonate was used in place of 60.0 mg of 2-[2,4-(2,2-dimethyl-1,3-propano)-5-(6-methoxy-3-pentylbenzothiazoline-2-ylidene)-1,3-pentadienyl]-3-ethyl-6-methoxybenzothiazolium iodide. The grain size distribution of the emulsion was 0.07. From determination of the X-ray diffraction, the emulsion grains were found to show a diffraction pattern corresponding to silver chloride of from 53 to 90%, in addition to the main peak of silver chloride 100%.

Emulsion (G) was prepared in the same manner as Emulsion (D), except that 0.04 mg of ammonium hexachlororhodate(III) monohydrate was added to the aqueous sodium chloride solution to be added in the second time and 286.7 mg of pyridinium 2-[5-phenyl-2-{2-[5-phenyl-3-(2-sulfonatoethyl)benzoxazolin-2-ylidenemethyl]-1-butenyl}-3-benzoxazolio]ethanesulfonate was added in place of 60.0 mg of 2-[2,4-(2,2-dimethyl-1,3-propano)-5-(6-methoxy-3-pentylbenzothiazolin-2-ylidene)-1,3-pentadienyl]-3-ethyl-6-methoxybenzothiazolium iodide.

Emulsion (H) was prepared in the same manner as of emulsion (A), except that the temperature for formation of the silver halide grains and the time required for adding the aqueous silver nitrate solution and aqueous alkali halide solution were varied. In preparation of emulsion (H), 172.8 mg of 3-{2-[5-chloro-3-(3-sulfonatopropyl)benzothiazolin-2-ylidenemethyl]-3-naphtho-[1,2-d]thiazolio}propanesulfonic acid was used in place of 2-[2,4-(2,2-dimethyl-1,3-propano)-5-(6-methoxy-3-pentylbenzothiazolin-2-ylidene)-1,3-pentadienyl]-3-ethyl-6-methoxybenzothiazolium, and the emulsion was optimally chemically sensitized to obtain a surface latent image type emulsion.

TABLE 1

| Emulsion | Shape | Grain Size (Distribution) | Main Peak (Halogen Composition of Substrate) | Diffraction Pattern | Silver Bromide Locallized Phase | Polyvalent Metal Ion Present |
|---|---|---|---|---|---|---|
| A | Cubic | 0.51 μ (0.08) | Cl 80% (Br 20%) | — | No | — |
| B | " | 0.50 μ (0.07) | Cl 98% (Br 2%) | — | " | — |
| C | " | 0.50 μ (0.08) | Cl 100% | Cl 83-90% | Yes | — |
| D | " | 0.50 μ (0.08) | Cl 100% | Cl 61-90% | Yes | — |
| E | " | 0.50 μ (0.08) | Cl 100% | Cl 61-90% | Yes | Rh(III), Fe(II), Ir(IV) |
| F | " | 1.03 μ (0.07) | Cl 100% | Cl 53-90% | Yes | Fe(II), Ir(IV) |
| G | " | 0.50 μ (0.09) | Cl 100% | Cl 61-90% | Yes | Rh(III) |
| H | " | 0.80 μ (0.12) | Cl 80% (Br 20%) | — | No | — |

Preparation of Coupler-emulsified Dispersion 45.0 ml of ethyl acetate, 5.6 g of solvent (e), 5.2 ml of solvent (f) and 5.2 ml of solvent (g) were added to 14.5 g of cyan coupler (a), 8.8 g of dye image stabilizer (b), 1.8 g of stabilizer (c) and 15.8 g of stabilizer (d) and dissolved, and the resulting solution was dispersed by emulsification in 320 ml of an aqueous 10% gelatin solution containing 20 ml of 10% sodium dodecylbenzenesulfonate, to obtain an emulsified dispersion.

A magenta coupler dispersion and yellow coupler dispersion were also prepared in the same manner as above.

Preparation of Color Photographic Material

Titanium oxide-containing polyethylene was coated on both surfaces of a white paper base to form a reflective paper support, which was then treated by corona discharge treatment and then a subbing layer was coated thereover. Next, the layers having the compositions shown below were coated on the resulting support to obtain a color photographic material sample.

As a gelatin hardening agent in each layer, sodium 1-oxy-3,5-dichloro-s-triazine was used.

| Layer constitution: | |
|---|---|
| Support: | |
| Polyethylene-coated Paper (containing titanium oxide white pigment and ultramarine in the polyethylene of the first layer side) | |
| First Layer: Antihalation Layer | |
| Colloidal Silver | 0.18 g/m$^2$ |
| Gelatin | 0.80 g/m$^2$ |
| Second Layer: Blue-sensitive Layer | |
| Silver Halide Emulsion (see Table 2) | 0.27 g/m$^2$ |
| Gelatin | 1.20 g/m$^2$ |
| Yellow Coupler (h) | 0.68 g/m$^2$ |
| Color Image Stabilizer (i) | 0.17 g/m$^2$ |
| Solvent (j) | 0.27 g/m$^2$ |
| Third Layer: Color Mixing Preventing Layer | |
| Gelatin | 0.99 g/m$^2$ |
| Color Mixing Preventing Agent (k) | 0.08 g/m$^2$ |
| Fourth Layer: Green-sensitive Layer | |
| Silver Halide Emulsion (see Table 2) | 0.36 g/m$^2$ |
| Gelatin | 1.00 g/m$^2$ |
| Magenta Coupler (n) | 0.32 g/m$^2$ |
| Color Image Stabilizer (o) | 0.06 g/m$^2$ |
| Color Image Stabilizer (p) | 0.13 g/m$^2$ |
| Solvent (j) | 0.42 g/m$^2$ |
| Fifth Layer: Ultraviolet Absorbing Layer | |
| Gelatin | 1.60 g/m$^2$ |
| Ultraviolet Absorbent (l) | 0.62 g/m$^2$ |
| Color Mixing Preventing Agent (m) | 0.05 g/m$^2$ |

-continued

| Layer constitution: | |
|---|---|
| Solvent (g) | 0.26 g/m$^2$ |
| Sixth Layer: Red-sensitive Layer | |
| Silver Halide Emulsion (see Table 2) | 0.24 g/m$^2$ |
| Gelatin | 0.95 g/m$^2$ |
| Cyan Coupler (a) | 0.40 g/m$^2$ |
| Color Image stabilizer (b) | 0.24 g/m$^2$ |
| Stabilizer (c) | 0.44 g/m$^2$ |
| Stabilizer (d) | 0.05 g/m$^2$ |
| Solvent (e) | 0.15 g/m$^2$ |
| Solvent (f) | 0.14 g/m$^2$ |
| Solvent (g) | 0.14 g/m$^2$ |
| Seventh Layer: Ultraviolet Absorbing Layer | |
| Gelatin | 0.54 g/m$^2$ |
| Ultraviolet Absorbent (l) | 0.21 g/m$^2$ |
| Solvent (g) | 0.09 g/m$^2$ |
| Eighth Layer: Protective Layer | |
| Gelatin | 1.33 g/m$^2$ |
| Acryl-modified Copolymer of Polyvinyl Alcohol (modification degree 17%) | 0.17 g/m$^2$ |

In the above-mentioned layer constitution, the amount of the silver halide and that of the colloidal silver were expressed by the amount of silver.

The following dyes were incorporated into the sample for the purpose of anti-irradiation or adjustment of the sensitivity.

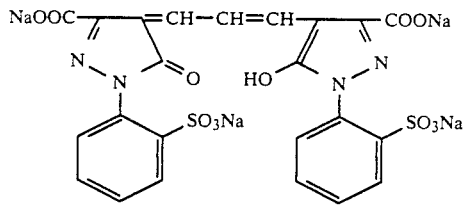

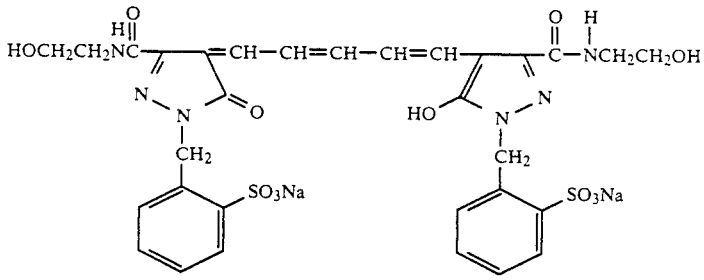

TABLE 2

| Sample No. | First Layer | Second Layer | Fourth Layer | Sixth Layer | Note |
|---|---|---|---|---|---|
| 1 | No | Silver Halide Emulsion (H) | Silver Halide Emulsion (G) | Silver Halide Emulsion (A) | Comparison |
| 2 | " | Silver Halide Emulsion (H) | Silver Halide Emulsion (G) | Silver Halide Emulsion (B) | " |
| 3 | Yes | Silver Halide Emulsion (H) | Silver Halide Emulsion (G) | Silver Halide Emulsion (A) | " |
| 4 | " | Silver Halide Emulsion (H) | Silver Halide Emulsion (G) | Silver Halide Emulsion (B) | " |
| 5 | " | Silver Halide Emulsion (F) | Silver Halide Emulsion (G) | Silver Halide Emulsion (A) | " |
| 6 | " | Silver Halide Emulsion (F) | Silver Halide Emulsion (G) | Silver Halide Emulsion (B) | " |
| 7 | " | Silver Halide Emulsion (F) | Silver Halide Emulsion (G) | Silver Halide Emulsion (C) | " |
| 8 | " | Silver Halide Emulsion (F) | Silver Halide Emulsion (G) | Silver Halide Emulsion (D) | " |
| 9 | " | Silver Halide Emulsion (F) Compound (6) ($2 \times 10^{-3}$ mol per mol of Ag) | Silver Halide Emulsion (G) | Silver Halide Emulsion (E) Compound (Z) ($2 \times 10^{-3}$ mol per mol of Ag) | The Invention |

TABLE 2-continued

| Sample No. | First Layer | Second Layer | Fourth Layer | Sixth Layer | Note |
|---|---|---|---|---|---|
| 10 | Yes<br>Compound (6)<br>($2 \times 10^{-3}$ mol per mol of Ag) | Silver Halide Emulsion (F) | Silver Halide Emulsion (G) | Silver Halide Emulsion (E)<br>Compound (Z)<br>($2 \times 10^{-3}$ mol per mol of Ag) | " |
| 11 | Yes | Silver Halide Emulsion (F)<br>Compound (18)<br>($4 \times 10^{-3}$ mol per mol of Ag) | Silver Halide Emulsion (G) | Silver Halide Emulsion (E)<br>Compound (Z)<br>($2 \times 10^{-3}$ mol per mol of Ag) | The Invention |
| 12 | Yes<br>Compound (6)<br>($2 \times 10^{-3}$ mol per mol of Ag) | Silver Halide Emulsion (F) | Silver Halide Emulsion (G)<br>Compound (9)<br>($2 \times 10^{-3}$ mol per mol of Ag)<br>Compound (Z)<br>(0.01 g/m$^2$) | Silver Halide Emulsion (E)<br>Compound (9)<br>($1 \times 10^{-3}$ mol per mol of Ag) | " |
| 12" | Yes<br>Compound (6)<br>($2 \times 10^{-3}$ mol per mol of Ag) | Silver Halide Emulsion (H) | Silver Halide Emulsion (G) | Silver Halide Emulsion (A) | " |

Notes: In Table 2 Compounds (6), (18) and (9) are those represented by formulae (I), (III) and (I), respectively.

The compounds used in preparation of the above-mentioned samples were as follows.

Cyan Coupler (a):

-continued

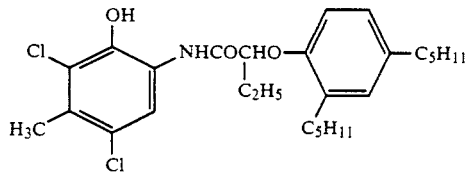

Color Image Stabilizer (b):
Mixture (1/3/3. by mol) of the following compounds

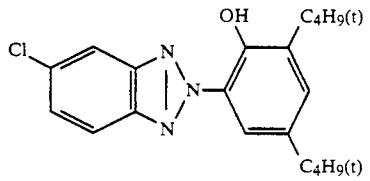

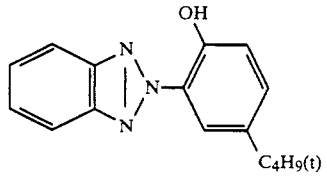

and

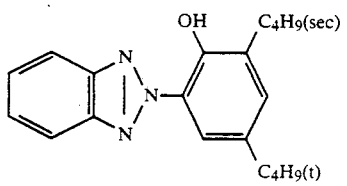

Stabilizer (c):

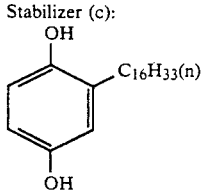

Stabilizer (d):

-continued
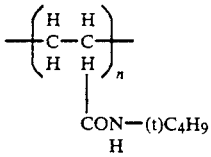
(number mean molecular weight: 60,000)
Solvent (e):
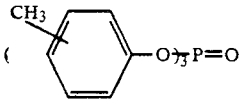
Solvent (f):
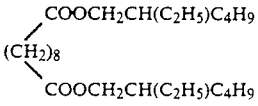
Solvent (g):
$(iso C_9H_{19}O)_3P{=}O$
Yellow Coupler (h):
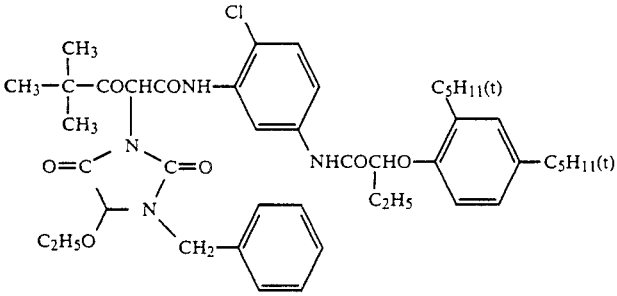
Color Image Stabilizer (i):
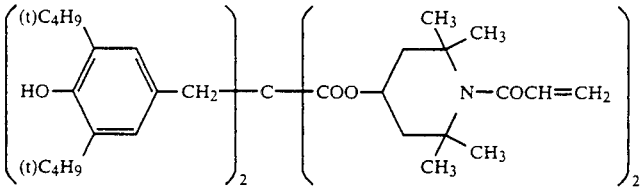
Solvent (j):
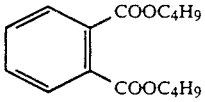
Color Mixing Preventing Agent (k):
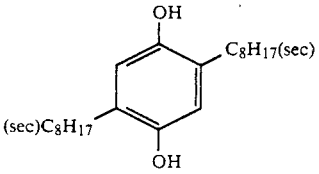
Ultraviolet Absorbent (l):
Mixture (1/5/3, by mol) of the following compounds

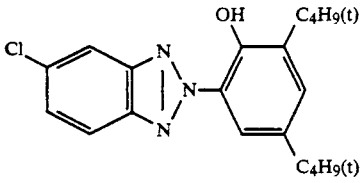
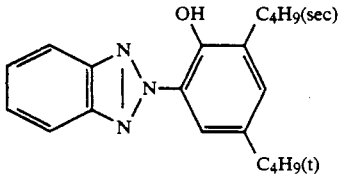
and
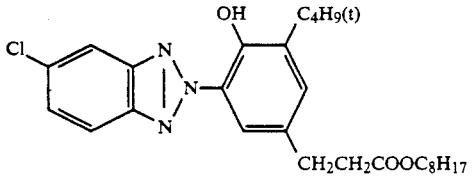
Color Mixing Preventing Agent (m):
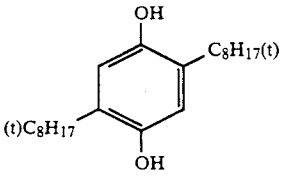
Magenta Coupler (n):
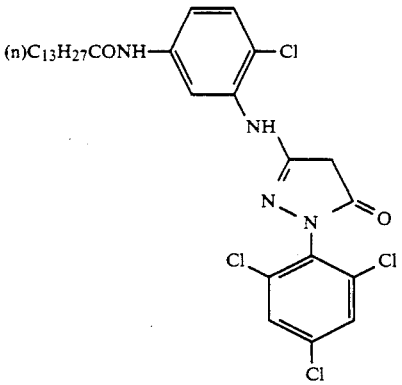
Color Image Stabilizer (o):
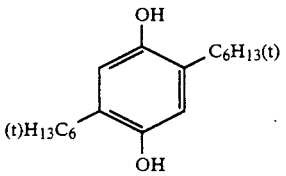
Color Image Stabilizer (p):
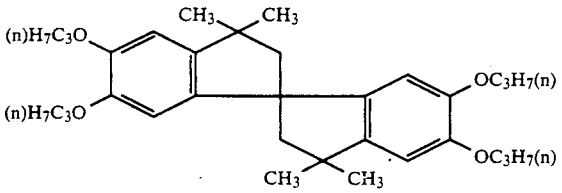
Sensitivity Stabilizer (z):

-continued

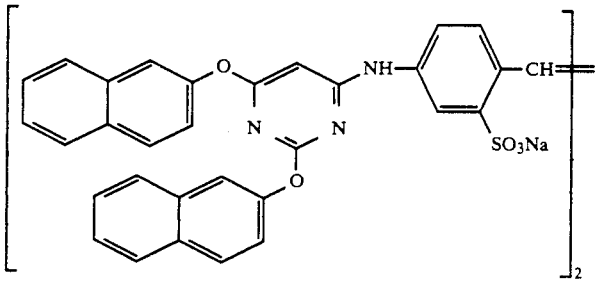

Each of the thus prepared samples Nos. 1 to 12 was wedgewise exposed through a blue filter, green filter or red filter as applied to the light source (color temperature: 3200°K.) and then processed for color development in accordance with the procedure mentioned below. The reflection density of each of the thus processed samples was determined. Dmin corresponds to the color density of the non-exposed part obtained by the present color development. As the yellow stain was noticeable in the tested samples, the degree of the stain was expressed by the blue filter density. In addition, sample Nos. 1, 3, 8, 9, 10, 11 and 12 were subjected to green-exposure for determination of the CTF value (resolving power), and the data of lines/mm (at 50% CTF) were obtained. The results are shown in Table 3 below.

| Processing Steps | Temperature | Time |
|---|---|---|
| Color Development | 35° C. | 45 sec |
| Bleach-fixation | 30 to 35° C. | 45 sec |
| Rinsing (1) | 30 to 35° C. | 20 sec |
| Rinsing (2) | 30 to 35° C. | 20 sec |
| Rinsing (3) | 30 to 35° C. | 20 sec |
| Rinsing (4) | 30 to 35° C. | 30 sec |
| Drying | 70 to 80° C. | 60 sec |

(The rinsing step was carried out using a four-tank countercurrent system from tank (4) to tank (1).)

The processing solutions used had the following compositions.

| | |
|---|---|
| Color Developer: | |
| Water | 800 ml |
| Ethylenediamine-N,N,N,N-tetramethylenephosphonic acid | 1.5 g |
| Triethylenediamine(1,4-diazabicyclo-[2,2,2]octane) | 5.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| Brightening agent (UVITEX CK, by Ciba-Geigy) | 2.0 g |
| Water to make | 1000 ml |
| pH (25° C.) | 10.10 |
| Bleach-fixing Solution: | |
| Water | 400 ml |
| Ammonium thiosulfate (70% aqueous solution) | 100 ml |
| Sodium sulfite | 18 g |
| Ammonium (ethylenediaminetetra-acetato)iron(III) | 55 g |
| Disodium ethylenediaminetetraacetate | 3 g |
| Ammonium bromide | 40 g |
| Glacial acetic acid | 8 g |
| Water to make | 1000 ml |
| pH (25° C.) | 5.5 |
| Rinsing Solution: | |

-continued

| |
|---|
| Ion-exchanged water (content of calcium and magnesium were 3 ppm or less, individually.) |

TABLE 3

| Sample | Dmax Yellow | Dmin Blue Filter (Density) | Resolving Power Magenta Image c/mm (CTF 50%) |
|---|---|---|---|
| 1 | 1.90 | 0.07 | 13 |
| 2 | 2.03 | 0.08 | — |
| 3 | 1.98 | 0.11 | 16 |
| 4 | 2.05 | 0.12 | — |
| 5 | 2.26 | 0.12 | — |
| 6 | 2.25 | 0.13 | — |
| 7 | 2.22 | 0.13 | — |
| 8 | 2.25 | 0.12 | 16 |
| 9 | 2.22 | 0.09 | 18 |
| 10 | 2.25 | 0.08 | 17 |
| 11 | 2.20 | 0.09 | 17 |
| 12 | 2.26 | 0.09 | 20 |
| 12′ | 2.00 | 0.08 | 17 |

As is obvious from the results in Table 3 above, the resolving power (sharpness) of sample No. 1 having no colloidal silver layer was low. Sample Nos. 3 and 8 each having the colloidal silver layer had a high resolving power, but the stain (Dmin) increased in these samples. As opposed to these samples, sample Nos. 9 to 12 of the present invention, which had the colloidal silver layer and further had the mercaptoazole compounds, were noted to have a lowered stain and an elevated resolving power. Sample No. 12′ was noted to have a lower stain and higher resolving power as compared with sample No. 3 having the same colloidal silver and silver halide emulsion layers. When compound (8) represented by formula (I) was used instead of compound (6), a higher yellow color density was obtained.

Next, sample Nos. 1 and 4 were processed by the color-developing process described below where the color development step was prolonged up to 90 seconds. As a result, these obtained a sufficient color density. However, when sample Nos. 3 and 4 were processed by the same prolonged procedure, these had a noticeable yellow stain. (Dmin was 0.12 to 0.13.)

| Processing Steps | Temperature | Time |
|---|---|---|
| Color Development | 38° C. | 1 min 30 sec |
| Bleach Fixation | 35° C. | 60 sec |
| Rinsing (1) | 33 to 35° C. | 20 sec |
| Rinsing (2) | 33 to 35° C. | 20 sec |
| Rinsing (3) | 33 to 35° C. | 20 sec |
| Drying | 70 to 80° C. | 50 sec |

The processing solutions used had the following compositions.

| | |
|---|---|
| Color Developer: | |
| Water | 800 ml |
| Diethylenetriaminepentaacetic acid | 1.0 g |
| Nitrilotriacetic acid | 2.0 g |
| 1-Hydroxyethylidene-1,1-diphosphonic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-ethyl-N-(β-methanesulfonamidoethyl)-3-methyl-4-aminoaniline sulfate | 5.5 g |
| Hydroxylamine sulfate | 2.0 g |
| Brightening agent (WHITEX 4, by Sumitomo Chemical Company Limited) | 1.5 g |
| Water to make | 1000 ml |
| pH (25° C.) | 10.20 |
| Bleach-fixing Solution: | |
| Water | 400 ml |
| Ammonium thiosulfate (70% aqeous solution) | 80 ml |
| Ammonium sulfite | 24 g |
| Ammonium (ethylenediaminetetra-acetato)iron(III) | 30 g |
| Disodium ethylenediaminetetraacetate | 5 g |
| Water to make | 1000 ml |
| pH (25° C.) | 6.50 |
| Rinsing Solution: | |
| Ion-exchanged water (content of calcium and magnesium were 3 ppm or less, individually.) | |

EXAMPLE 2

| | |
|---|---|
| Preparation of Emulsion (I): | |
| Solution-1: | |
| $H_2O$ | 1000 ml |
| NaCl | 3.3 g |
| Gelation | 32 g |
| Solution-2: | |
| Sulfuric acid (1N) | 24 ml |
| Solution-3: | |
| Compound (A) (1% aqueous solution) | 3 ml |

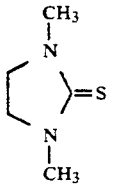

| | |
|---|---|
| Solution-4: | |
| NaCl | 11.00 g |
| $H_2O$ to make | 200 ml |
| Solution-5: | |
| $AgNO_3$ | 32.00 g |
| $H_2O$ to make | 200 ml |
| Solution-6: | |
| NaCl | 44.00 g |
| $K_2IrCl_6$ (0.001%) | 2.3 ml |
| $H_2O$ to make | 560 ml |
| Solution-7: | |
| $AgNO_3$ | 128 g |
| $H_2O$ to make | 560 ml |

Solution-1 was heated to 52° C., and solution-2 and solution-3 were added thereto. Next, solution-4 and solution-5 were simultaneously added thereto over a period of 14 minutes. After 10 minutes, solution-6 and solution-7 were simultaneously added over a period of 15 minutes. Next, pyridinium 2-[5-phenyl-2-{2-[5-phenyl-3-(2-sulfonatobutyl)benzoxazolin-2-ylidenemethyl]-1-butenyl}-3-benzoxazolio]butanesulfonate was added in an amount of $4.0\times10^{-4}$ mol per mol of the silver halide, and then ultra-fine silver bromide grain emulsion (grain size: 0.05μ) was added in an amount of 1 mol % of silver bromide to silver chloride. The resulting emulsion was ripened at 58° C. for 10 minutes. After being cooled, the emulsion was desalted and water and gelatin for dispersion were added. The pH of the emulsion was adjusted to 6.2. A monodispersed cubic silver chlorobromide emulsion was obtained, which had a mean grain size of 0.48 μm and a fluctuation coefficient (value obtained by dividing the standard deviation by the mean grain size and represented by $s/\bar{d}$) of 0.10.

The emulsion was optimally chemically sensitized with sodium thiosulfate at 58° C. to give a surface latent image type emulsion. This was called emulsion (I).

| | |
|---|---|
| Preparation of Emulsion (J): | |
| Formation of Silver Chloride Host Grains: | |
| Solution-1: | |
| $H_2O$ | 1000 cc |
| NaCl | 5.5 g |
| Gelatin | 32 g |
| Solution-2: | |
| Sulfuric acid (1N) | 24 cc |
| Solution-3: | |
| Compound (A) (1% aqueous solution) | 3 cc |

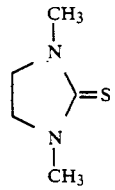

| | |
|---|---|
| Solution-4: | |
| NaCl | 1.7 g |
| $H_2O$ to make | 200 cc |
| Solution-5: | |
| $AgNO_3$ | 5 g |
| $H_2O$ to make | 200 cc |
| Solution-6: | |
| NaCl | 41.3 g |
| $K_2IrCl_6$ (0.001% aqueous solution) | 0.5 cc |
| $H_2O$ to make | 600 cc |
| Solution-7: | |
| $AgNO_3$ | 120 g |
| $H_2O$ to make | 600 cc |

Solution-1 was heated up to 76° C., and solution-2 and solution-3 were added thereto.

Next, solution-4 and solution-5 were simultaneously added thereto over a period of 10 minutes.

After 10 minutes, solution-6 and solution-7 were simultaneously added over a period of 35 minutes. 5 minutes after the addition, the temperature of the resulting emulsion was lowered and the emulsion was desalted. Water and gelatin for dispersion were added and the pH was adjusted to 6.3. A monodispersed cubic silver chloride emulsion was obtained, which had a mean grain size of 1.1 μm and a fluctuation coefficient (value obtained by dividing the standard deviation by the mean grain size and represented by $s/\bar{d}$) of 0.10.

The emulsion was divided into two equal parts, and 75.6 mg of the aforesaid blue-sensitizing dye was added to one part. An ultra-fine silver bromide grain emulsion was added thereto in an amount of 0.5 mol % on the basis of the silver chloride content in the emulsion and the emulsion was ripened for 10 minutes at 58° C. Afterwards sodium thiosulfate was added so that the emulsion was optimally chemically sensitized. The emulsion thus obtained was called Emulsion (J).

Preparation of Emulsion (K)

Emulsion (K) was prepared in the same manner as emulsion (I), except that 2-[2,4-(2,2'-dimethyl-1,3-propano)-5-(6-methyl-3-pentylbenzothiazolin-2-ylidene)-1,3-pentadienyl]-3-ethyl-6-methylbenzothiazolium iodide was added in an amount of $2.0\times10^{-4}$ mol per mol of the silver halide in place of the aforesaid green-sensitizing dye.

Preparation of Sample Nos. 13 to 20

Sample No. 13 was prepared in the same manner as sample No. 8 of Example 1, except that emulsion (J) was used in the second layer in place of silver halide emulsion (F), emulsion (I) was used in the fourth layer in place of emulsion (G), and emulsion (K) was used in the sixth layer in place of emulsion (E). Sample Nos. 14 to 17 were also prepared, each having the layer constitution as indicated in Table 4 below.

Sample No. 18 was the same as sample No. 17, except that the former had an interlayer having the composition described below between the first layer and the second layer.

| Composition of Interlayer: | |
|---|---|
| Gelatin | 0.50 g/m$^2$ |
| Compound (14) of formula (IV) | 0.20 g/m$^2$ |

-continued

| Composition of Interlayer: | |
|---|---|
| Solvent (u) | 0.05 g/m$^2$ |
| Dye (y) | 0.01 g/m$^2$ |

Sample No. 19 was the same as sample No. 17, except that the following compound was added to the first layer.

| Compound Added to 1st Layer: | |
|---|---|
| Compound (5) of formula (V) | 0.15 g/m$^2$ |

Sample No. 20 was the same as sample No. 18, except that compound (7) of formula (V) (0.10 g/m$^2$) was added to the aforesaid interlayer, compound (8) of formula (IV) (0.10 g/m$^2$) was added to the second layer and compound (2) of formula (IV) (0.15 g/m$^2$) was added to the fifth layer.

Sample No. 8 and sample Nos. 13 to 20 were wedgewise exposed through a blue filter applied to a light source (color temperature: 3200°K.) and then color-developed in accordance with the process of Example 1. The density of the thus processed samples was determined, and the results obtained are shown in Table 5 below.

TABLE 3

| Sample No. | First Layer | Second Layer | Fourth Layer | Sixth Layer | Note |
|---|---|---|---|---|---|
| 13 | Gelatin 0.80 g/m$^2$<br>Colloidal Silver 0.18 g/m$^2$ | Emulsion (J)<br>0.27 g/m$^2$ as Ag | Emulsion (I)<br>0.36 g/m$^2$ as Ag | Emulsion (K)<br>0.24 g/m$^2$ as Ag | Comparison |
| 14 | Gelatin 0.80 g/m$^2$<br>Colloidal Silver 0.25 g/m$^2$ | Emulsion (J)<br>0.27 g/m$^2$<br>Compound (9)<br>$1\times10^{-4}$ mol per mol of Ag | Emulsion (I)<br>0.36 g/m$^2$ as Ag<br>Compound (9)<br>$5\times10^{-4}$ mol per mol of Ag | Emulsion (K)<br>0.24 g/m$^2$ as Ag<br>Compound (9)<br>$5\times10^{-4}$ mol per mol of Ag | The Invention |
| 15 | Gelatin 0.80 g/m$^2$<br>Colloidal Silver 0.25 g/m$^2$<br>Compound (16)<br>$1\times10^{-4}$ mol per mol of Ag | Same as above | Emulsion (I)<br>0.36 g/m$^2$ as Ag<br>Compound (9)<br>$2\times10^{-4}$ mol per mol of Ag | Emulsion (K)<br>0.24 g/m$^2$ as Ag<br>Compound (9)<br>$10^{-4}$ mol per mol of Ag | " |
| 16 | Gelatin 0.80 g/m$^2$<br>Colloidal Silver 0.25 g/m$^2$<br>Compound (18)<br>$1\times10^{-4}$ mol per mol of Ag | Emulsion (J)<br>0.27 g/m$^2$ as Ag<br>Compound (11)<br>$2\times10^{-4}$ mol per mol of Ag | Same as above | Same as above | " |
| 17 | Same as above | Same as above | Emulsion (I)<br>0.36 g/m$^2$ as Ag<br>Compound (9)<br>$2\times10^{-4}$ mol per mol of Ag<br>Coupler (q) 0.32 g/m$^2$<br>Stain Inhibitor<br>(r) 0.05 g/m$^2$<br>(s) 0.04 g/m$^2$<br>Solvent (t) 0.37 g/m$^2$ | Emulsion (K)<br>0.24 g/m$^2$ as Ag<br>Compound (9)<br>$10^{-4}$ mol per mol of Ag<br>Coupler (v) 0.20 g/m$^2$<br>Coupler (x) 0.20 g/m$^2$ | " |

Notes:

Sample Nos. 13 to 17 had the same layer constitution (1st to 8th layers) as shown in Example 1, except that "see Table 2" was replaced by "see Table 4".

Compound (9) is represented by formula (I), Compounds (11) and (16) are represented by formula (II) and Compound (18) is represented by formula (III).

The compounds used in preparation of the above-mentioned samples were as follows.

Magenta Coupler (g):

-continued
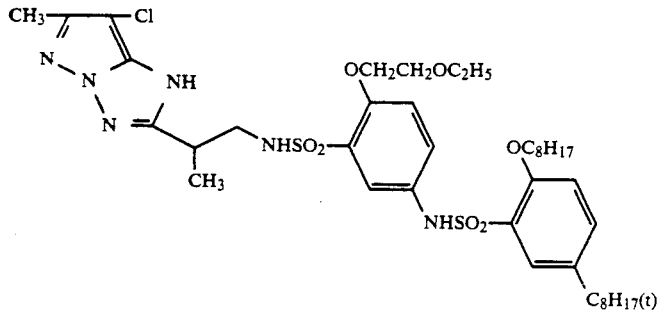
Stain Inhibitor (r):
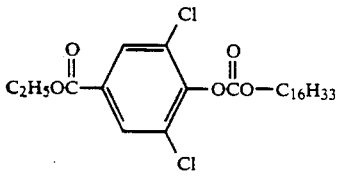
Stain Inhibitor (s):
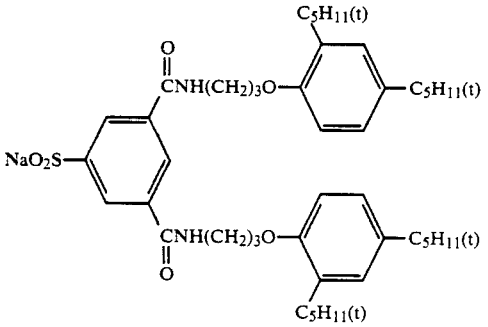
Solvent (t):
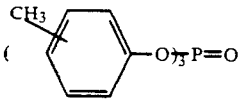
Solvent (u):
$(C_8H_{17}O)_3P{=}O$
Coupler (v):
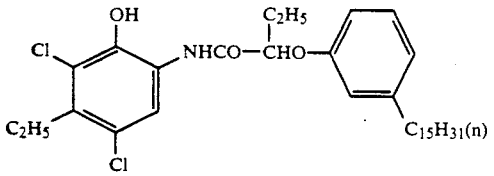
Coupler (x):
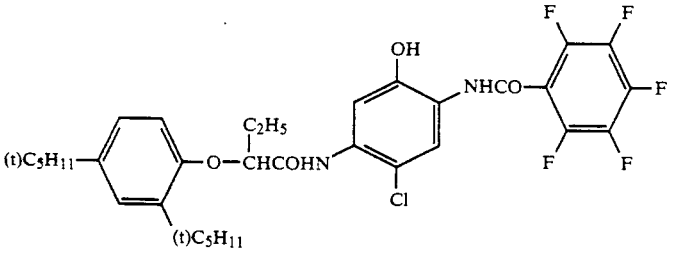
Dye (y):

-continued

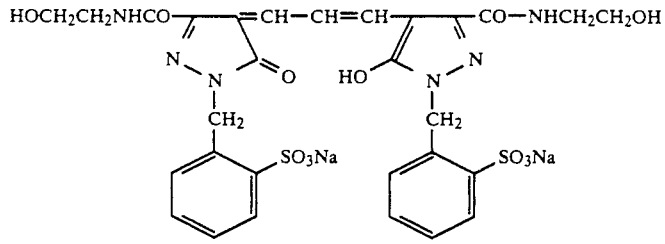

TABLE 5

| Sample | Dmax Yellow | Dmin | |
|---|---|---|---|
| 8 | 2.25 | 0.12 | Comparison |
| 13 | 2.30 | 0.18 | Comparison |
| 14 | 2.26 | 0.08 | The Invention |
| 15 | 2.25 | 0.07 | " |
| 16 | 2.25 | 0.08 | " |
| 17 | 2.25 | 0.09 | " |
| 18 | 2.28 | 0.07 | " |
| 19 | 2.25 | 0.06 | " |
| 20 | 2.24 | 0.06 | " |

From the results in Table 5, it is noted that sample No. 13 formed by coating emulsion (J), emulsion (I) and emulsion (K) had a high maximum color density (Dmax) and was rapidly developed at a high development rate, but it had an extreme stain (high Dmin) because of the colloidal silver layer therein. As opposed to this, sample Nos. 14 to 17 of the present invention, which contained the pyrazoloazole compound had an extremely reduced stain. Sample Nos. 18 to 20 which additionally contained the compound of the formula (IV) or (V) had a further reduced stain.

In accordance with the present invention, improvement of the sharpness of the image formed on a high silver chloride photographic material can be attained by provision of a colloidal silver-containing layer in the material, without deteriorating the rapid-processability, stability and whiteness of the material. The present invention can therefore be applied not only to color photographic papers but also to other color recording materials having a reflective support.

In particular, the present invention is conveniently applied to color photographic papers having an enhanced and improved whiteness, whereby the excellent characteristic of the sharpness of color negative photographic materials can be displayed to give color prints having an excellent whiteness. The photographic materials of the present invention can effectively be processed in a shortened development time of 90 seconds or less, or in a shortened total processing time of 200 seconds or less, to obtain improved color prints of high image quality.

While the invention has been described in detail and with reference to specific embodiments thereof, it will be apparent to one skilled in the art that various changes and modifications can be made therein without departing from the spirit and scope thereof.

What is claimed is:

1. A method of processing a silver halide photographic light-sensitive material having at least one light-sensitive emulsion layer containing surface latent image-type silver halide grains, coated on a reflective support, in which said at least one emulsion layer contains regular crystal grains of silver chloride or silver chlorobromide having a mean silver chloride content of 80 mol % or more on the basis of the total silver halide grains present therein and substantially does not contain silver iodide, and in which a colloidal silver-containing layer is located adjacent to said emulsion layer, wherein at least one of said colloidal silver-containing layer, said emulsion layer and an interlayer therebetween contains at least one mercaptoazole compounds, comprising imagewise exposing said material and then processing said material, with a color developer which does not contain any bromide or sulfite, within 60 seconds.

2. The method of processing the silver halide color photographic light-sensitive material as claimed in claim 1, wherein the developer substantially does not contain benzyl alcohol.

3. The method of processing the silver halide color photographic light-sensitive material as claimed in claim 1, wherein at least 50% by weight of silver halide grains (based on the total silver halide grains) present in said emulsion layer have at least one silver bromide localized phase inside of and/or on the surface of each of the grains.

4. The method of processing the silver halide color photographic light-sensitive material as claimed in claim 1, wherein the content of the colloidal silver in the colloidal silver-containing layer is from 0.01 to 0.5 $g/m^2$ silver.

5. The method of processing the silver halide color photographic light-sensitive material as claimed in claim 1, wherein the colloidal silver is a yellow or black colloidal silver.

6. The method of processing the silver halide color photographic light-sensitive material as claimed in claim 1, wherein the mercaptoazole compound is at least one compound selected from the group consisting of compounds represented by formulae (I), (II) or (III), or precursors thereof:

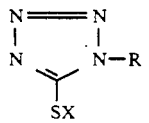

(I)

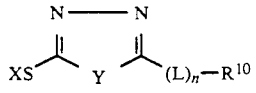

(II)

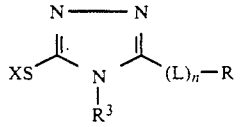

(III)

wherein R and $R^3$ each represents an alkyl group, an alkenyl group or an aryl group;

X represents a hydrogen atom, an alkali metal atom, an ammonium group or a precursor thereof;

Y represents an oxygen atom or a sulfur atom;

L represents a dilvalent linking group;

$R^{10}$ represents a hydrogen atom, an alkyl group, an alkenyl group and an aryl group;

and n represents 0 or 1.

7. The method of processing the silver halide color photographic light-sensitive material as claimed in claim 1, wherein the mercaptoazole compound is present in an amount of from $1\times10^{-5}$ to $1\times10^{-3}$ mol per ml of the total amount of silver in the colloidal silver-containing layer and in the adjacent light-sensitive layer, the silver halide being calculated as silver.

8. The method of processing the silver halide color photographic light-sensitive material as claimed in claim 1, wherein at least one of the colloidal silver layer, the adjacent emulsion layer and an interlayer therebetween contains a compound selected from the group consisting of compounds represented by formula (IV) or (V):

$$Cp—X^1 \quad (IV)$$

$$A_1—P—Ar—Q—A_2 \quad (V)$$

wherein Cp represents a colorless coupler residue capable of forming a substantially colorless compound by coupling with an oxidation product of a color developing agent or a coupler residue capable of forming a compound, which is able to be dissolved or diffused out of the layer of the photographic material, by coupling in color development;

$X^1$ represents a coupling-releasing group;

$A_1$ and $A_2$ each represents a hydrogen atom or a group capable of being cleaved by action of an alkali;

P and Q each represents an oxygen atom or a sulfonylimino group; Ar represents an aromatic group; and $A_1$—P— and —Q—$A_2$ are bonded to the 1,2-positions or 1,4-positions of the aromatic group.

9. The method of processing the silver halide color photographic light-sensitive material as claimed in claim 8, in which the compound of formula (IV) is one represented by formula (VI):

$$\underset{\underset{X^2}{|}}{Cpp}—(Sol)_b \quad (VI)$$

wherein Sol represents an alkali-soluble group;

b represents an integer of from 1 to 3;

Cpp represents a group capable of releasing the group $X^2$ in a coupling reaction with an oxidation product of a developing agent; and $X^2$ represents a non-diffusible group-containing coupling-releasing group.

10. The method of processing the silver halide color photographic light-sensitive material as claimed in claim 9, in which the compound of formula (VI) is one selected from compounds of the general formulae (Cp-1), (Cp-2), (Cp-3), (Cp-4), (Cp-5), (Cp-6), (Cp-7) and (Cp-8)

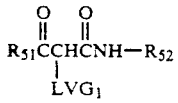
(Cp-1)

-continued

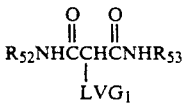
(Cp-2)

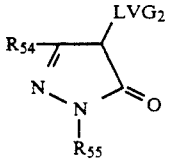
(Cp-3)

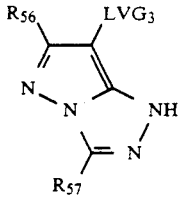
(Cp-4)

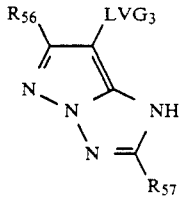
(Cp-5)

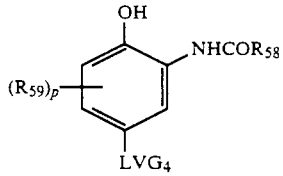
(Cp-6)

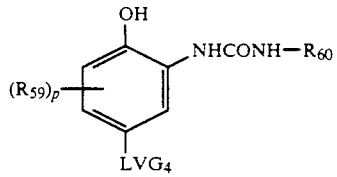
(Cp-7)

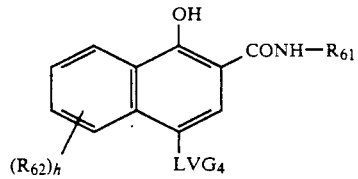
(Cp-8)

wherein $R_{51}$, $R_{52}$, $R_{53}$, $R_{54}$, $R_{55}$, $R_{56}$, $R_{57}$, $R_{58}$, $R_{59}$, $R_{60}$, $R_{61}$ and $R_{62}$ independently have a total carbon number of 15 or less;

$R_{51}$, $R_{52}$, $R_{53}$, $R_{55}$, $R_{58}$, $R_{60}$ and $R_{61}$ may optionally contain Sol group as a substituent;

$R_{54}$, $R_{56}$, $R_{57}$, $R_{59}$ and $R_{62}$ may optionally contain Sol as a substituent, or they may be Sol;

$R_{51}$ is the same as $R_{41}$, which represents an aliphatic group, an aromatic group or a heterocyclic group;

$R_{52}$ and $R_{53}$ each represents an aromatic group or a heterocyclic group;

$R_{54}$ has the same meaning as $R_{41}$ and additionally represents $R_{41}CON(R_{43})-$, $R_{41}N(R_{43})-$, $R_{41}SO_2N(R_{43})-$, $R_{41}S-$, $R_{43}O-$, $R_{45}NCO(R_{43})-N(R_{44})-$, $R_{43}OOC-$, $R_{44}NCO(R_{43})-$ or $N\equiv C-$;

$R_{43}$, $R_{44}$ and $R_{45}$ each represents a hydrogen atom, an aliphatic group, and aromatic group or a heterocyclic group;

$R_{55}$ has the same meaning as $R_{41}$;

$R_{56}$ and $R_{57}$ have the same meaning as $R_{43}$ and additionally represent $R_{41}S-$, $R_{43}O-$, a carboxyl group, $R_{41}CON(R_{43})-$, $R_{41}N(R_{43})-$, $R_{41}OCON(R_{43})-$, $R_{43}NCO(R_{44})-N(R_{45})-$ or $R_{41}SO_2N(R_{43})-$;

$R_{58}$ has the same meaning as $R_{41}$;

$R_{59}$ has the same meaning as $R_{41}$ and additionally represents $R_{41}CON(R_{43})-$, $R_{41}OCON(R_{43})-$, $R_{41}SO_2N(R_{43})-$, $R_{43}OOC-$, $R_{43}NCO(R_{44})-N(R_{45})-$, $R_{43}NSO_2N(R_{44})(R_{45})-$, a sulfonic acid group or a salt thereof, $R_{41}O-$, $R_{41}S-$, a halogen atom or $R_{41}N(R_{43})-$;

p represents an integer of from 0 to 3;

when p is a plural number, plural $R_{59}$'s may be the same or different, or they may be bonded to each other in the form of a divalent group to form a cyclic structure;

$R_{60}$ and $R_{61}$ each has the same meaning as $R_{41}$;

$R_{62}$ has the same meaning as $R_{41}$ and additionally represents $R_{41}CONH-$, $R_{41}OCONH-$, $R_{41}SO_2NH-$, a carboxyl group, a sulfonic acid group or a salt thereof, $R_{43}NCO(R_{44})-N(R_{45})-$, $R_{43}NSO_2N(R_{44})(R_{45})-$, $R_{43}O-$, $R_{41}S-$, a halogen atom or $R_{41}N(R_{43})-$;

h represents an integer of from 0 to 4;

when the formula has plural $R_{62}$'s, they may be the same or different;

$LVG_1$ represents $R_{65}O$, an imido group to be bonded to the coupling position via the nitrogen atom, a 5-membered or 6-membered unsaturated nitrogen-containing heterocyclic group bonded to the coupling position via the nitrogen atom, or $R_{66}S-$;

$LVG_2$ represents $R_{66}S-$, $R_{65}O$, $R_{65}-N=N-$ or a 5-membered or 6-membered unsaturated nitrogen-containing heterocyclic group bonded to the coupling position via the nitrogen atom;

$LVG_3$ represents $R_{66}S-$ or a 5-membered or 6-membered unsaturated nitrogen-containing heterocyclic group bonded to the coupling position via the nitrogen atom;

$LVG_4$ represents $R_{66}O-$, $R_{65}N=N-$ or $R_{66}S-$;

$R_{65}$ represents an aromatic group or a heterocyclic group; and $R_{66}$ represents an aliphatic group, an aromatic group or a heterocyclic group.

11. The method of processing the silver halide color photographic light-sensitive material as claimed in claim 8, in which the compound of formula (V) is one represented by general formula (VII):

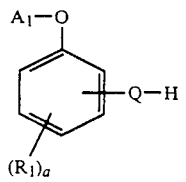

(VII)

wherein $A_1$ and Q have the same meanings as those defined for formula (V);

—Q—H is positioned in the 2- or 4-position to $A_1$—O— in the benzene ring;

$R_1$ represents a group which may be substituted in the benzene ring; a represents an integer of from 1 to 4; when a is 2 or more, plural $R_1$'s may be the same or different; when two $R_1$'s are adjacent substituents on the benzine ring, they may be bonded to each other to form a cyclic structure.

12. The method of processing the silver halide color photographic light-sensitive material as claimed in claim 8, wherein the amount of the compound represented by formula (IV) or (V) is from 0.01 to 0.2 g/m$^2$.

13. The method of processing the silver halide color photographic light-sensitive material as claimed in claim 12, wherein the colloidal silver is present in at least one of an antihalation layer provided between the support and said silver halide emulsion layer closest to the support, and a light-filter layer.

14. The method of processing the silver halide color photographic light-sensitive material as claimed in claim 1, wherein the material has at least one of blue-, green- and red-sensitive layers.

15. The method of processing the silver halide color photographic light-sensitive material as claimed in claim 1, wherein said mean silver chloride content is 90 mol % or more.

16. The method of processing the silver halide color photographic light-sensitive material as claimed in claim 1, wherein at least 70% by weight of silver halide grains based on the total silver halide grains present in said emulsion layer have at least one silver bromide localized phase inside of and/or on the surface of each of the grains.

* * * * *